US008392202B2

(12) United States Patent
Taleb

(10) Patent No.: US 8,392,202 B2
(45) Date of Patent: Mar. 5, 2013

(54) LOW-COMPLEXITY SPECTRAL ANALYSIS/SYNTHESIS USING SELECTABLE TIME RESOLUTION

(75) Inventor: Anisse Taleb, Kista (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 510 days.

(21) Appl. No.: 12/675,461

(22) PCT Filed: Aug. 25, 2008

(86) PCT No.: PCT/SE2008/050959

§ 371 (c)(1), (2), (4) Date: Feb. 26, 2010

(87) PCT Pub. No.: WO2009/029032

PCT Pub. Date: Mar. 5, 2009

(65) Prior Publication Data

US 2010/0250265 A1 Sep. 30, 2010

Related U.S. Application Data

(60) Provisional application No. 60/968,125, filed on Aug. 27, 2007.

(51) Int. Cl.
*G10L 21/00* (2006.01)

(52) U.S. Cl. ..... 704/503; 704/500; 704/504

(58) Field of Classification Search ..... None
See application file for complete search history.

(56) References Cited

U.S. PATENT DOCUMENTS

| | | | |
|---|---|---|---|
| 6,115,689 | A | 9/2000 | Malvar |
| 2001/0001853 | A1 | 5/2001 | Mauro et al. |
| 2005/0114126 | A1 | 5/2005 | Geiger et al. |

FOREIGN PATENT DOCUMENTS

| | | | |
|---|---|---|---|
| WO | 2006030289 | A1 | 3/2006 |

OTHER PUBLICATIONS

Monta, P., et al., "Low Rate Audio Coder With Hierarchical Filterbanks and Lattice Vector Quantization", Acoustics, Speech, and Signal Procesing, ICASSP-94, 1994 IEEE international Conference, pp. II/209-II/212, vol. 2, Apr. 19-22, 1994.

*Primary Examiner* — Justin Rider
(74) *Attorney, Agent, or Firm* — Rothwell, Figg, Ernst & Manbeck, P.C.

(57) ABSTRACT

The signal processing is based on the concept of using a time-domain aliased (12, TDA) frame as a basis for time segmentation (14) and spectral analysis (16), performing segmentation in time based on the time-domain aliased frame and performing spectral analysis based on the resulting time segments. The time resolution of the overall ?segmented? time-to-frequency transform can thus be changed by simply adapting the time segmentation to obtain a suitable number of time segments based on which spectral analysis is applied. The overall set of spectral coefficients, obtained for all the segments, provides a selectable time-frequency tiling of the original signal frame.

45 Claims, 22 Drawing Sheets

$v(n)$

10

LOW-COMPLEXITY SPECTRAL ANALYSIS/SYNTHESIS USING SELECTABLE TIME RESOLUTION

CROSS-REFERENCE TO RELATED APPLICATIONS

This application is a 35 U.S.C. §371 National Phase Application from PCT/SE2008/050959, filed Aug. 25, 2008, and designating the United States, and claims priority to Provisional Application No. 60/968,125, filed Aug. 27, 2007. The above-mentioned applications are incorporated by reference herein.

TECHNICAL FIELD

The present invention generally relates to signal processing such as signal compression and audio coding, and more particularly to audio encoding and audio decoding and corresponding devices.

BACKGROUND

An encoder is a device, circuitry or computer program that is capable of analyzing a signal such as an audio signal and outputting a signal in an encoded form. The resulting signal is often used for transmission, storage and/or encryption purposes. On the other hand a decoder is a device, circuitry or computer program that is capable of inverting the encoder operation, in that it receives the encoded signal and outputs a decoded signal.

In most state-of the art encoders such as audio encoders, each frame of the input signal is analyzed in the frequency domain. The result of this analysis is quantized and encoded and then transmitted or stored depending on the application. At the receiving side (or when using the stored encoded signal) a corresponding decoding procedure followed by a synthesis procedure makes it possible to restore the signal in the time domain.

Codecs are often employed for compression/decompression of information such as audio and video data for efficient transmission over bandwidth-limited communication channels.

In particular, there is a high market need to transmit and store audio signals at low bit rates while maintaining high audio quality. For example, in cases where transmission resources or storage is limited low bit rate operation is an essential cost factor. This is typically the case, for example, in streaming and messaging applications in mobile communication systems.

A general example of an audio transmission system using audio encoding and decoding is schematically illustrated in FIG. 1. The overall system basically comprises an audio encoder 10 and a transmission module (TX) 20 on the transmitting side, and a receiving module (RX) 30 and an audio decoder 40 on the receiving side.

It is commonly acknowledged that special care has to be taken in order to deal with non-stationary signals in particular for audio coding application and in general for signal compression. In audio coding, an artifact known as pre-echo distortion can arise in so-called transform coders.

Transform coders or more generally transform codecs (coder-decoder) are normally based around a time-to-frequency domain transform such as a DCT (Discrete Cosine Transform), a Modified Discrete Cosine Transform (MDCT) or another lapped transform. A common characteristic of transform codecs is that they operate on overlapped blocks of samples: overlapped frames. The coding coefficients resulting from a transform analysis or an equivalent sub-band analysis of each frame are normally quantized and stored or transmitted to the receiving side as a bit-stream. The decoder, upon reception of the bit-stream, performs dequantization and inverse transformation in order to reconstruct the signal frames.

Pre-echoes generally occur when a signal with a sharp attack begins near the end of a transform block immediately following a region of low energy.

This situation occur for instance when encoding the sound of percussion instruments, e.g. castanets, glockenspiel. In a block-based algorithm when quantizing the transform coefficients, the inverse transform at the decoder side will spread the quantization noise distortion evenly in time. This results in unmasked distortion on the low energy region proceeding in time the signal attack as illustrated in FIGS. 2A and B, where FIG. 2A illustrates the original percussion sound, and FIG. 2B illustrates the transform-coded signal showing the time spreading of coding noise leading to pre-echo distortion.

Temporal pre-masking is a psycho-acoustical property of the human hearing which has the potential to mask this distortion; however this is only possible when the transform block size is sufficiently small such that pre-masking occurs.

Pre-Echo Artifact Mitigation (Prior Art)

In order to avoid this undesirable artifact, several methodologies have been proposed and successfully applied. Some of theses technologies have been standardized and are widespread in commercial applications.

Bit Reservoir Techniques

The idea behind bit reservoir technique is to save some bits from frames that are "easy" to encode in the frequency domain. The saved bits are thereafter used in order to accommodate the high demanding frames, like transient frames. This result in a variable instantaneous bit-rate, with some tuning it can be made such that the average bit-rate is constant. The major drawback however is that very large reservoirs are in fact needed in order to deal with certain transients and this leads to very large delay making this technology with little interest for conversational application. In addition, this methodology only slightly mitigates the pre-echo artifact.

Gain Modification and Temporal Noise Shaping

The gain modification approach applies a smoothing of transient peaks in the time-domain prior to spectral analysis and coding. The gain modification envelope is sent as side information and inverse applied on the inverse transform signal thus shaping the temporal coding noise. A major drawback of the gain modification technique is in its modification of the filter bank (e.g. MDCT) analysis window, thus introducing a broadening of the frequency response of the filter bank. This may lead to problems at low frequencies especially if the bandwidth exceeds that of the critical band.

Temporal Noise Shaping (TNS) is inspired by the gain modification technique. The gain modification is applied in the frequency domain and operates on the spectral coefficients. TNS is applied only during input attacks susceptible to pre-echoes. The idea is to apply linear prediction (LP) across frequency rather than time. This is motivated by the fact that during transients and in general impulsive signals, frequency-domain coding gain is maximized by the use of LP techniques. TNS was standardized in AAC and is proven to provide a good mitigation of pre-echo artifacts. However, the use of TNS involves LP analysis and filtering which significantly increases the complexity of the encoder and decoder. Additionally, the LP coefficients have to be quantized and sent as side information which involves further complexity and bit-rate overhead.

Window Switching

FIG. 3 illustrates window switching (MPEG-1, layer III "mp3"), where transition windows "start" and "stop" are required between the long and short windows to preserve the PR (Perfect Reconstruction) properties. This technique was first introduced by Edler [1] and is popular for pre-echo suppression particularly in the case of MDCT-based transform coding algorithms. Window switching is based on the idea of changing the time resolution of the transform upon detection of a transient. Typically this involves changing the analysis block length from a long duration during stationary signals to a short duration when transients are detected. The idea is based on two considerations:

A short window applied to the short frame containing the transient will minimize the temporal spread of coding noise and allow temporal pre-masking to take effect and render the distortion inaudible.

Allocate higher bitrates to the short temporal regions containing the transient.

Although window switching has been very successful, it presents significant drawbacks. For instance, the perceptual model and lossless coding modules of the codec have to support different time resolutions which translate usually into increased complexity. In addition, when using lapped transforms such as the MDCT, and in order to satisfy the perfect reconstruction constraints, window switching needs to insert transition windows between short and long blocks, as illustrated in FIG. 3. The need for transition windows generates further drawbacks, namely an increased delay due to the fact that switching windows cannot be done instantaneously, and also the poor frequency localization properties of transition windows leading to a dramatic reduction in coding gain.

SUMMARY

The present invention overcomes these and other drawbacks of the prior art arrangements.

There is thus a general need for improved signal processing techniques and devices, and more particularly a special need for a new audio codec strategy for handling pre-echo distortion.

It is a general object of the present invention to provide an improved method and device for signal processing operating on overlapped frames of a time-domain input signal.

In particular it is desirable to provide an improved audio encoder.

It is another object of the invention to provide an improved method and device for signal processing operating based on spectral coefficients representative of a time-domain signal.

It is particularly desirable to provide an improved audio decoder.

These and other objects are met by the invention as defined by the accompanying patent claims.

A first aspect of the invention relates to a method and device for signal processing operating on overlapped frames of an input signal.

The invention is based on the concept of using a time-domain aliased frame as a basis for time segmentation and spectral analysis, performing segmentation in time based on the time-domain aliased frame and performing spectral analysis based on the resulting time segments.

The time resolution of the overall "segmented" time-to-frequency transform can thus be changed by simply adapting the time segmentation to obtain a suitable number of time segments based on which spectral analysis is applied.

More specifically, a basic idea is to perform time-domain aliasing (TDA) based on an overlapped frame to generate a corresponding time-domain aliased frame, and perform segmentation in time based on the time-domain aliased frame to generate at least two segments, also referred to as sub-frames. Based on these segments, spectral analysis is then performed to obtain, for each segment, coefficients representative of the frequency content of the segment.

The overall set of coefficients, also referred to as spectral coefficients, for all the segments provides a selectable time-frequency tiling of the original signal frame.

The instantaneous decomposition into segments can for example be used to mitigate the pre-echo effect, for instance in the case of transients, or generally to provide an efficient signal representation that allows bit-rate efficient encoding of the frame in question.

The first aspect of the invention is particularly related an audio encoder configured to operate in accordance with the above basic principles.

A second aspect of the invention relates to a method and device signal processing operating based on spectral coefficients representative of a time-domain signal. This aspect of the invention basically concerns the natural inverse operations of the signal processing of the first aspect of the invention. In brief, inverse segmented spectral analysis is performed based on different sub-sets of spectral coefficients to generate, for each sub-set of spectral coefficients, an inverse-transformed sub-frame also referred to as a segment. Then inverse time-segmentation is performed based on overlapped inverse-transformed sub-frames to combine these sub-frames into a time-domain aliased frame. Inverse time-domain aliasing is performed based on the time-domain aliased frame to enable reconstruction of the time-domain signal.

The second aspect of the invention is particularly related an audio decoder configured to operate in accordance with the above basic principles.

Further advantages offered by the invention will be appreciated when reading the below description of embodiments of the invention.

BRIEF DESCRIPTION OF THE DRAWINGS

The invention, together with further objects and advantages thereof, will be best understood by reference to the following description taken together with the accompanying drawings, in which.

DETAILED DESCRIPTION

Figure 1:
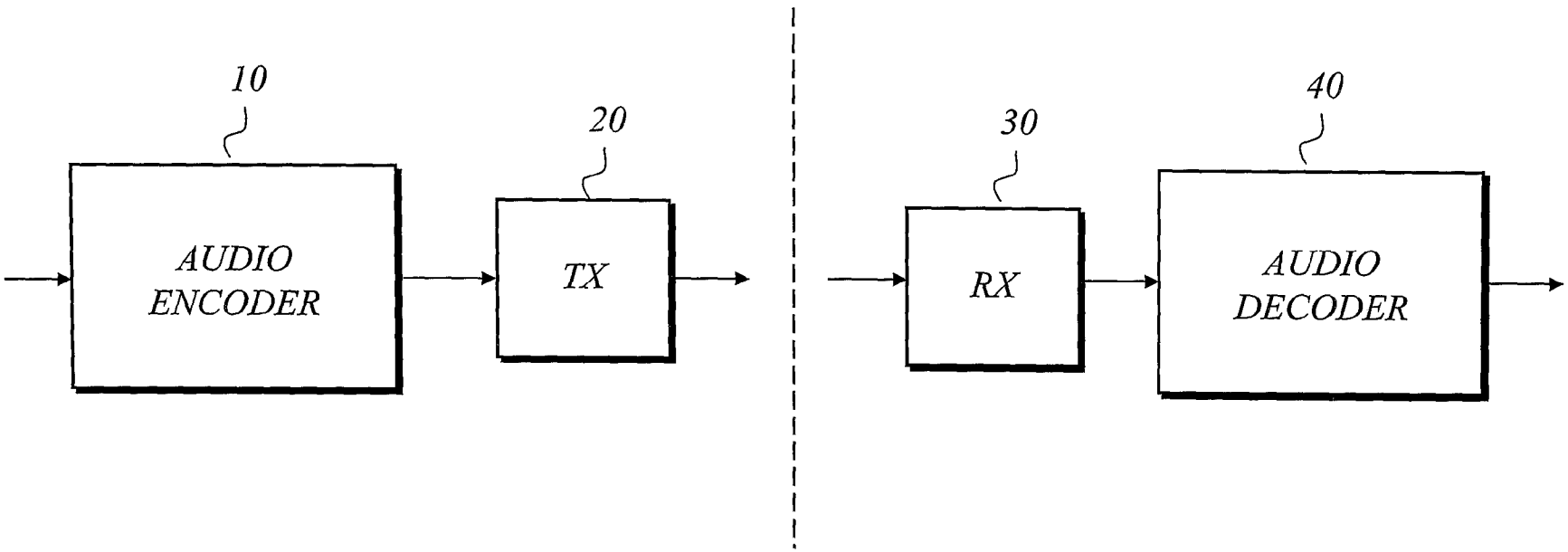
FIG. 1 is a schematic block diagram illustrating a general example of an audio transmission system using audio encoding and decoding.
Figure 2A:
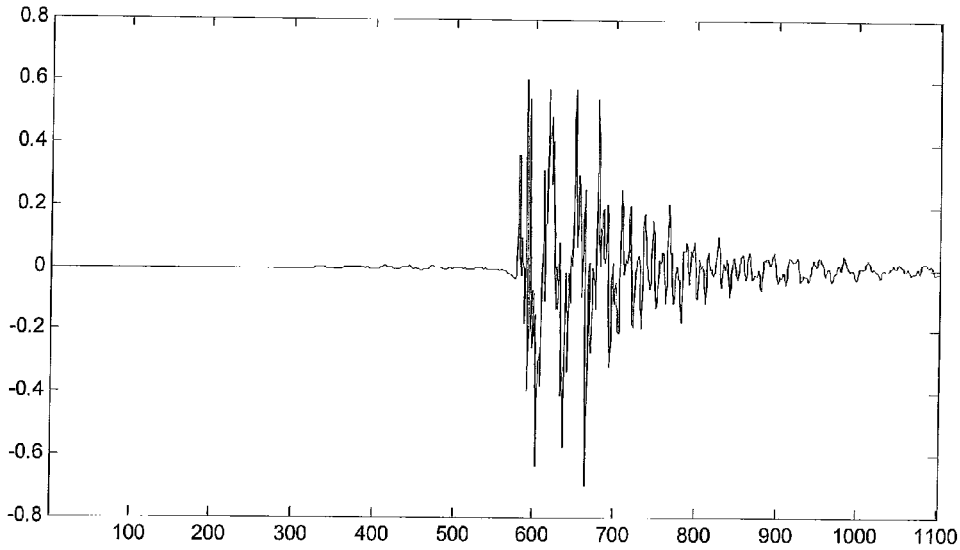
FIG. 2A illustrates an original percussion sound.
Figure 2B:
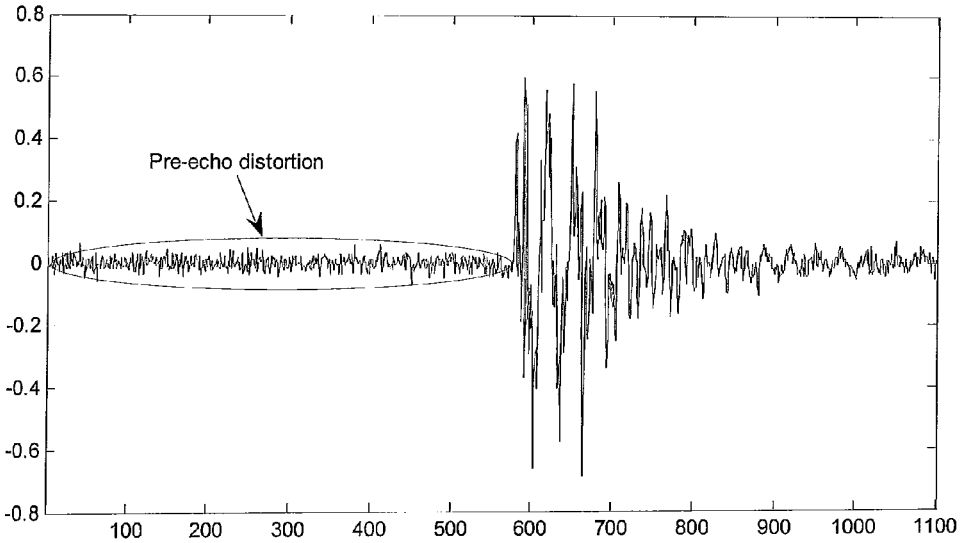
FIG. 2B illustrates a transform-coded signal showing the time spreading of coding noise leading to pre-echo distortion.
Figure 3:
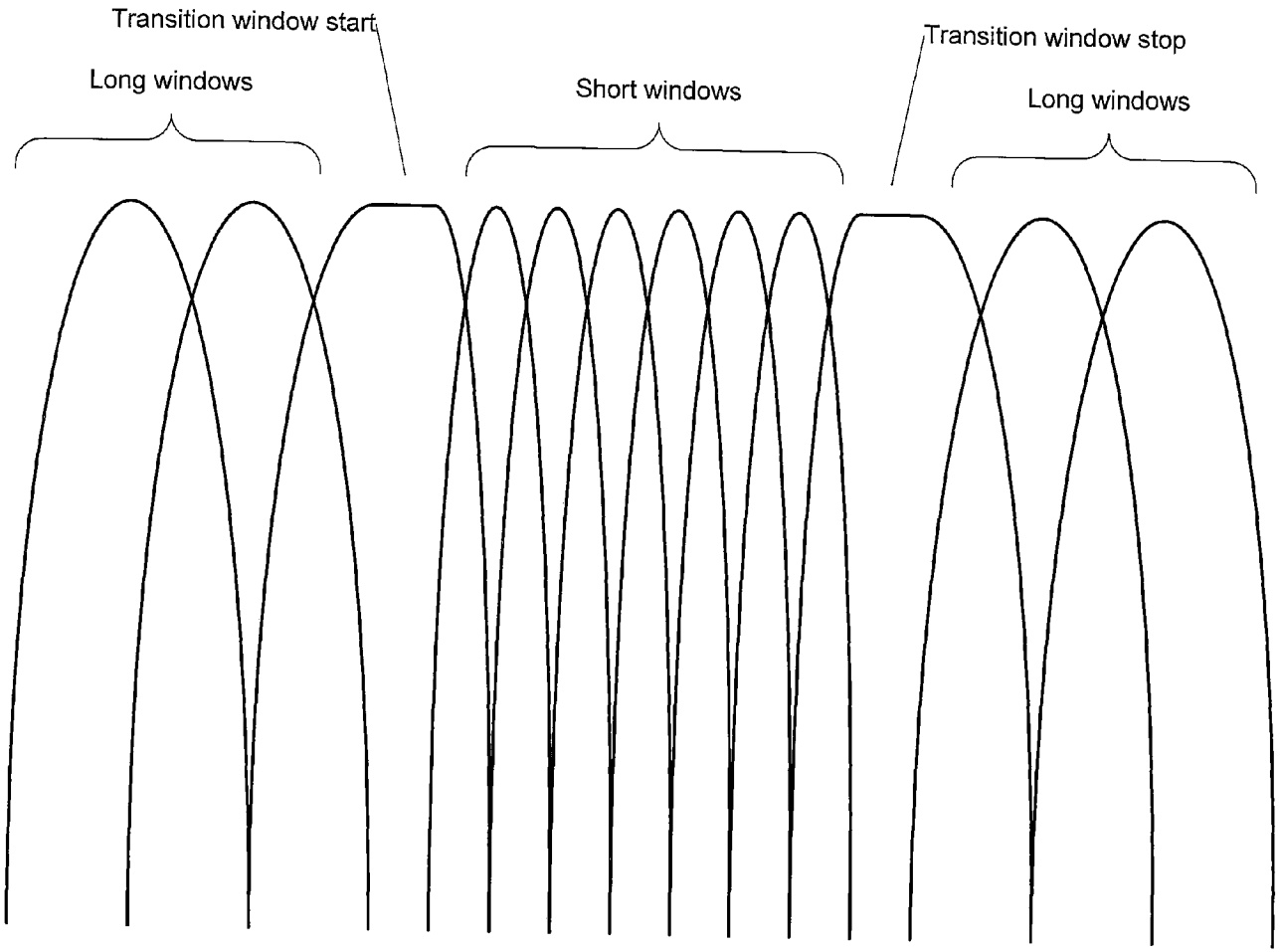
FIG. 3 illustrates the conventional window switching technique for transform-based coding.

Throughout the drawings, the same reference characters will be used for corresponding or similar elements.

For a better understanding of the invention, it may be useful to begin with a brief introduction to transform coding, and especially transform coding based on so-called lapped transforms.

As previously mentioned, transform codecs are normally based around a time-to-frequency domain transform such as a DCT (Discrete Cosine Transform), a lapped transform such as a Modified Discrete Cosine Transform (MDCT) or a Modulated Lapped Transform (MLT).

Figure 4A:
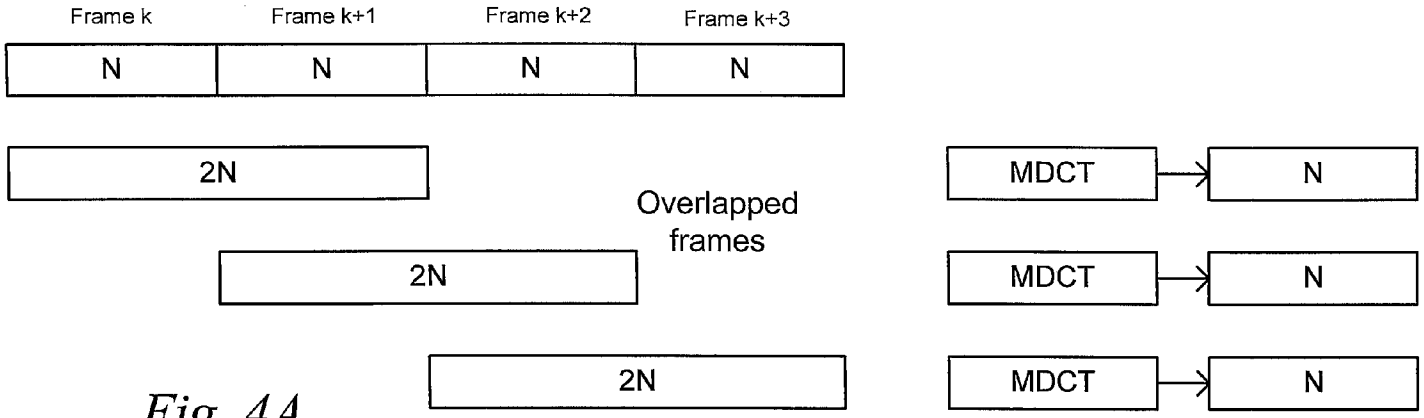
FIG. 4A schematically illustrates the general forward MDCT (Modified Discrete Cosine Transform) transform.

For example, the modified discrete cosine transform (MDCT) is a Fourier-related transform based on the type-IV discrete cosine transform (DCT-IV), with the additional property of being lapped: it is designed to be performed on consecutive blocks of a larger data set, where subsequent blocks are overlapped, so-called overlapped frames, so that the last half of one block coincides with the first half of the next block, as schematically illustrated in FIG. 4A. This overlapping, in addition to the energy-compaction qualities of the DCT, makes the MDCT especially attractive for signal compression applications, since it helps to avoid artifacts stemming from the block boundaries. Thus, an MDCT is employed in MP3, AC-3, Ogg Vorbis, and AAC for audio compression, for example.

As a lapped transform, the MDCT is somewhat different when compared to other Fourier-related transforms. In fact, the MDCT has half as many outputs as inputs. Formally, the MDCT is a linear mapping from, $R^{2N}$ into $R^N$ (where R denotes the set of real numbers).

Mathematically, the real numbers $x_0, x_1, \ldots, x_{2N}$ are transformed into the real numbers $X_0, X_1, \ldots, X_N$ according to the formula:

$$X_k = \sum_{n=0}^{2N-1} x_n \cos\left[\frac{\pi}{N}\left(n + \frac{1}{2} + \frac{N}{2}\right)\left(k + \frac{1}{2}\right)\right]$$

This above formula, depending on the convention, may contain an additional normalization coefficient.

Figure 4B:
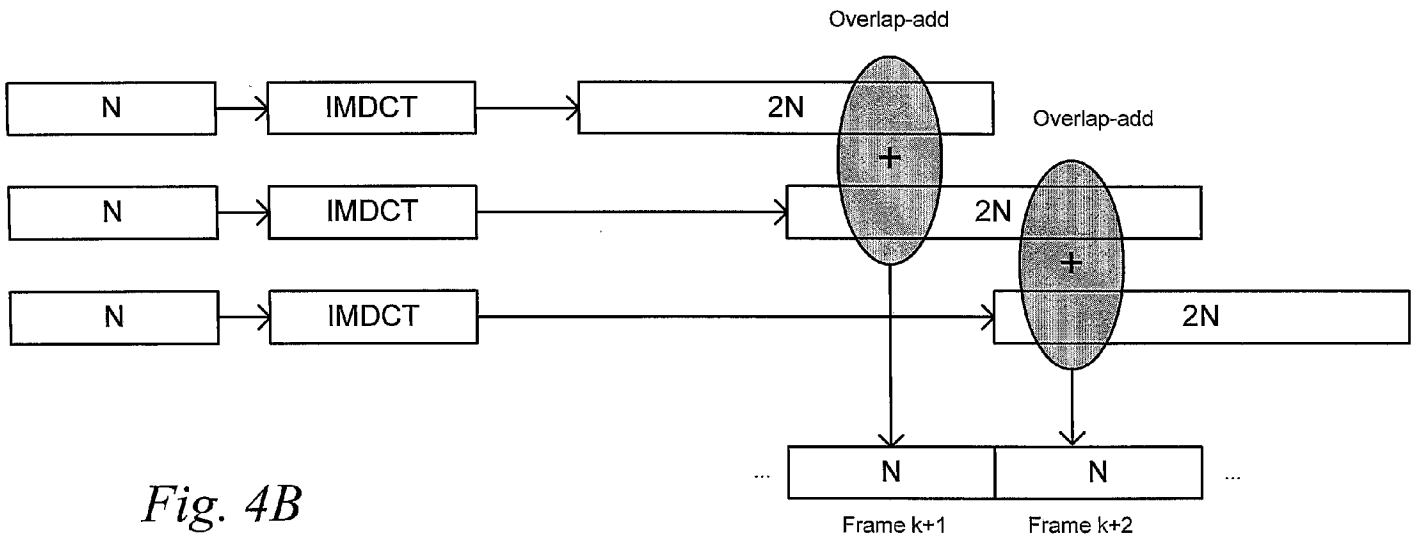
FIG. 4B schematically illustrates the general inverse MDCT (Modified Discrete Cosine Transform) transform.

The inverse MDCT is known as the IMDCT. Because, the dimensions of the output and input are different, at first glance it might seem that the MDCT should not be invertible. However, perfect invertibility is achieved by adding the overlapped IMDCT's of subsequent overlapping blocks, i.e. overlapped frames, causing the errors to cancel and the original data to be retrieved; this technique is known as time-domain aliasing cancellation (TDAC), and is schematically illustrated in FIG. 4B.

In summary, for the forward transform, 2N samples (of one of the overlapped frames) are mapped to N spectral coefficients, and for the inverse transform, N spectral coefficients are mapped to 2N time domain samples (of one of the reconstructed overlapped frames) which are overlap-added to form an output time domain signal.

The IMDCT transforms N real numbers $Y_0, Y_1, \ldots Y_N$, into real numbers $y_0, y_1, \ldots, y_{2N}$ according to the formula:

$$y_n = \frac{1}{N}\sum_{k=0}^{N-1} Y_k \cos\left[\frac{\pi}{N}\left(n + \frac{1}{2} + \frac{N}{2}\right)\left(k + \frac{1}{2}\right)\right]$$

In a typical signal-compression application, the transform properties are further enhanced using a window function $w_n$ that is multiplied with the input signal to the direct transform $x_n$ and the output signal of the inverse transform $y_n$. In principle, $x_n$ and $y_n$ could use different windows, but for simplicity only the case of identical windows is considered.

Several general purpose orthogonal and bi-orthogonal windows exist. In the orthogonal case, the generalized Perfect Reconstruction (PR) conditions can be reduced to linear phase and Nyquist constraints on the window, i.e.:

$$w(2N-1-n)=w(n)$$

$$w^2(n)+w^2(n+N)=1,$$

$$n=0 \ldots N-1$$

Any window which satisfies the Perfect Reconstruction (PR) conditions can be used to generate the filter bank. However, to obtain a high coding gain, the resulting frequency response of filter-bank should be as selective as possible.-

Reference [2] denotes by MLT (Modulated Lapped Transform) the MDCT filter bank that makes use of the sine window, defined as:

$$w(n) = \sin\left[\left(n + \frac{1}{2}\right)\frac{\pi}{2N}\right]$$

This particular window, the so-called sine window, is the most popular in audio coding. It appears for example in the MPEG-1 Layer III (MP3) hybrid filter bank, as well as the MPEG-2/4 AAC.

One of the attractive properties that has contributed to the widespread use of the MDCT for audio coding is the availability of FFT-based fast algorithms. This makes the MDCT a viable filter bank for real time implementations.

Figure 5:
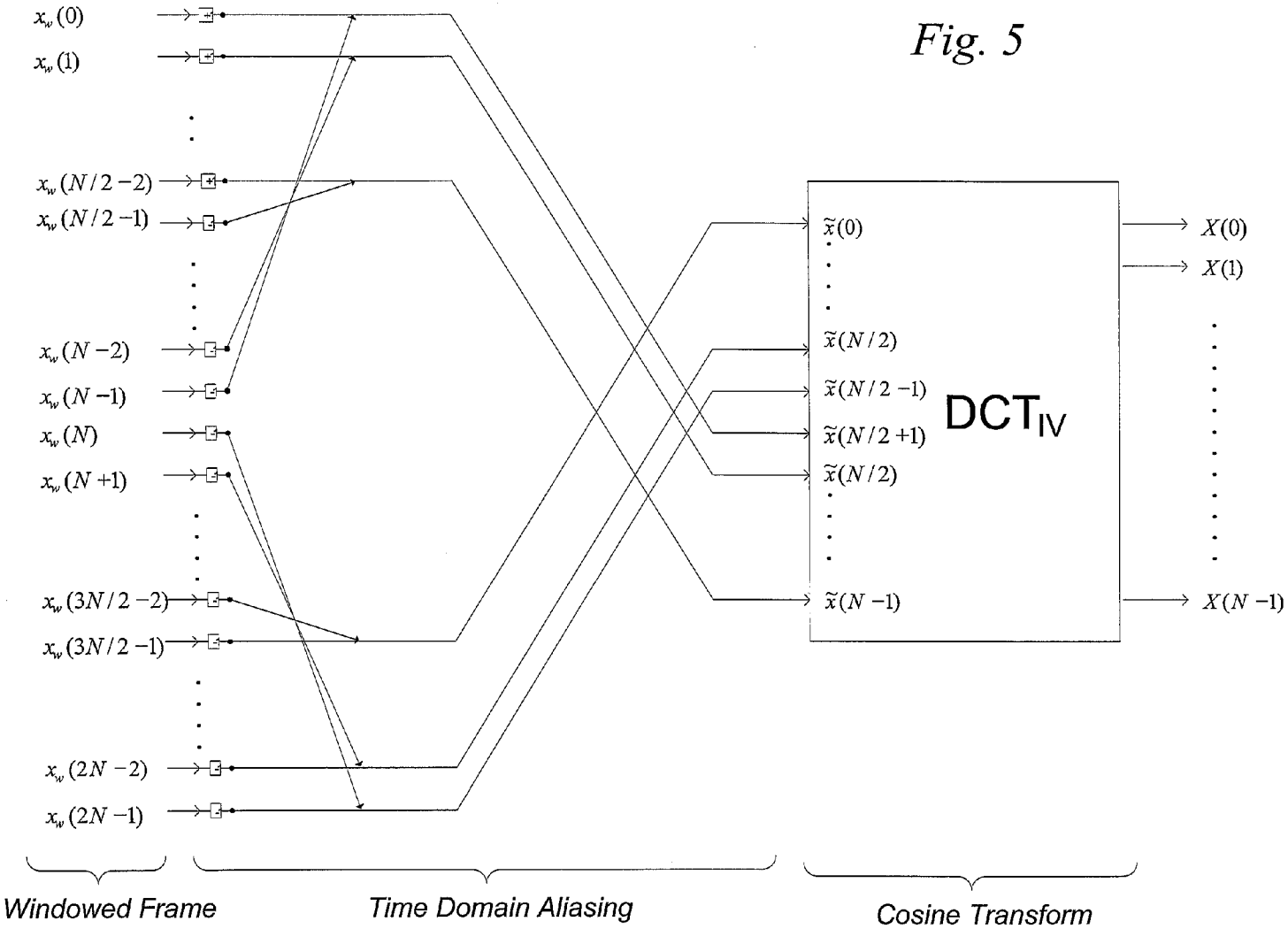
FIG. 5 is a schematic diagram illustrating the decomposition of the MDCT (Modified Discrete Cosine Transform) transform into two cascaded stages.

It is well known that the MDCT with a window length of 2N can be decomposed into two cascaded stages. The first stage consists of a time domain aliasing operation (TDA) followed by a second stage based on the type IV DCT, as illustrated in FIG. 5.

The TDA operation is explicitly given by the following matrix operation:

$$\tilde{x} = \begin{bmatrix} 0 & 0 & -J_N & -I_N \\ I_N & -J_N & 0 & 0 \end{bmatrix} x_w,$$

where $x_w$ denotes the windowed time domain input frame:

$$x_w(n) = w(n) \cdot x(n),$$

the matrices $I_N$ and $J_N$ denote the identity and the time reversal matrices of order N:

$$I_N = \begin{bmatrix} 1 & & 0 \\ & \ddots & \\ 0 & & 1 \end{bmatrix}, J_N = \begin{bmatrix} 0 & & 1 \\ & \iddots & \\ 1 & & 0 \end{bmatrix}.$$

A first aspect of the invention relates to signal processing operating on overlapped frames of an input signal. A key concept is to use a time-domain aliased frame as a basis for time segmentation and spectral analysis, and perform segmentation in time based on the time-domain aliased frame and spectral analysis based on the resulting time segments. The time segments, or segments in short, are also referred to as sub-frames. This is only natural since a segment of a frame may be referred to as a sub-frame. The expressions "segment" and "sub-frame" will in general be used interchangeably throughout the disclosure.

Figure 6:
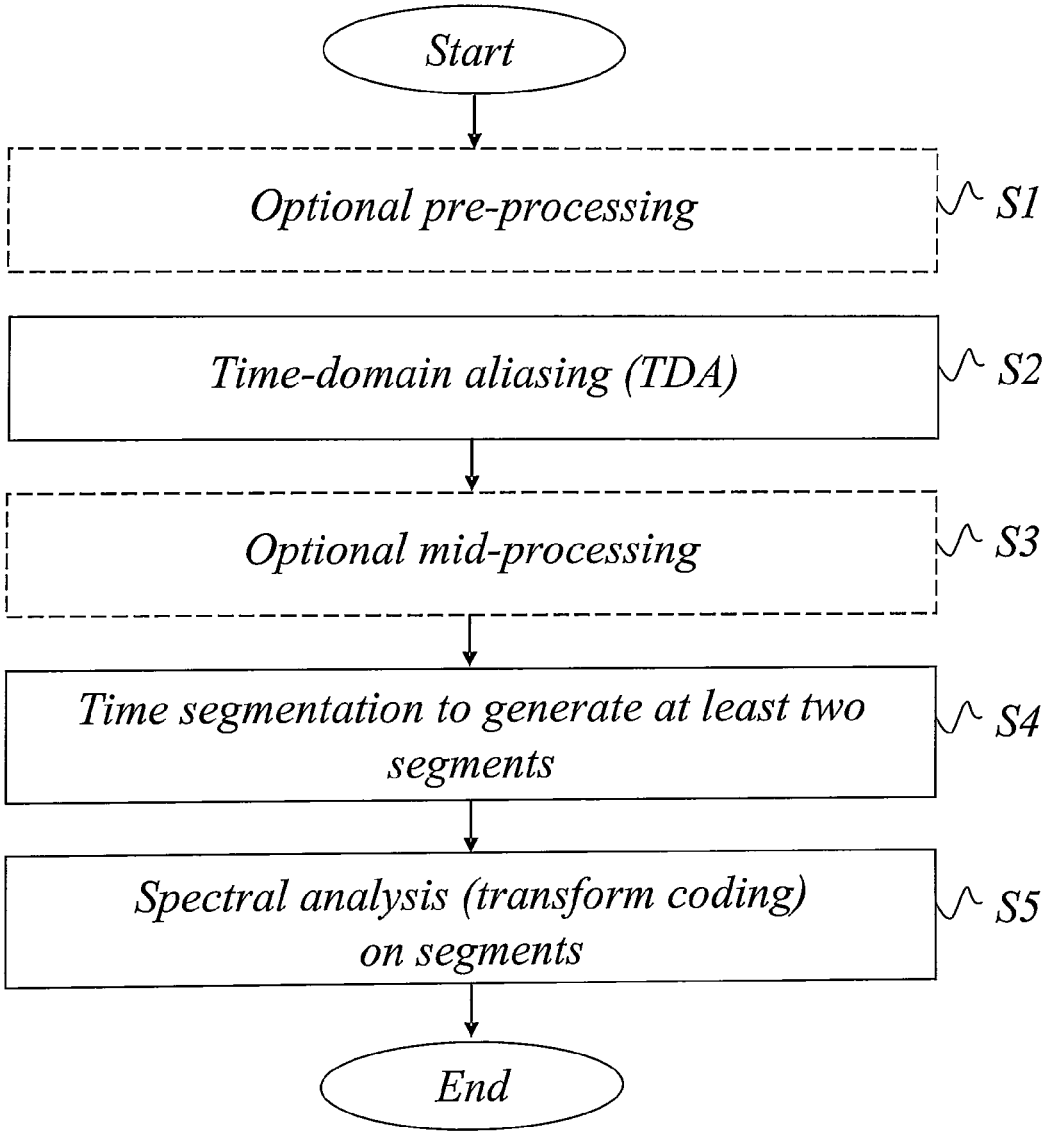
FIG. 6 is a schematic flow diagram illustrating an example of a method for signal processing according to a preferred exemplary embodiment of the invention.

FIG. 6 is a schematic flow diagram illustrating an example of a method for signal processing according to a preferred exemplary embodiment of the invention. As indicated in step S1, the procedure may involve an optional pre-processing step, as will be explained and exemplified later on. In step S2, a time-domain aliasing (TDA) operation is performed based on a selected one of the overlapped frames to generate a corresponding so-called TDA frame which may optionally be processed in one or more stages, as indicated in step S3, before time segmentation is performed. In any case, time segmentation is performed based on the time-domain aliased frame (which may have been processed) to generate at least two segments in time, as indicated in step S4. In step S5, so-called segmented spectral analysis is executed based on the segments to obtain, for each segment, coefficients representative of the frequency content of the segment. Preferably, the spectral analysis is based on applying a transform on each of the segments to produce, for each segment, a corresponding set of spectral coefficients. It is also possible to apply an optional post-processing step (not shown).

The spectral analysis may be based on any of a number of different transforms, preferably lapped transforms. Examples of different types of transforms include a Lapped Transform (LT), a Discrete Cosine Transform (DCT), a Modified Discrete Cosine Transform (MDCT), and a Modulated Lapped Transform (MLT).

The time resolution of the overall segmented time-to-frequency transform can thus be changed by simply adapting the time segmentation to obtain a suitable number of time segments based on which spectral analysis is applied. The segmentation procedure may be adapted to produce non-overlapped segments, overlapped segments, non-uniform length segments, and/or uniform length segments. In this way, any arbitrary time-frequency tiling of the original signal frame can be obtained.

The overall signal processing procedure typically operates on overlapped frames of a time-domain input signal on a frame-by-frame-basis, and the above steps of time-aliasing, segmentation, spectral analysis and optional pre-, mid- and post-processing are preferably repeated for each of a number of overlapped frames.

Preferably, the signal processing proposed by the present invention includes signal analysis, signal compression and/or audio coding. In an audio encoder, for example, the spectral coefficients will normally be quantized into a bit-stream for storage and/or transmission.

Figure 7:
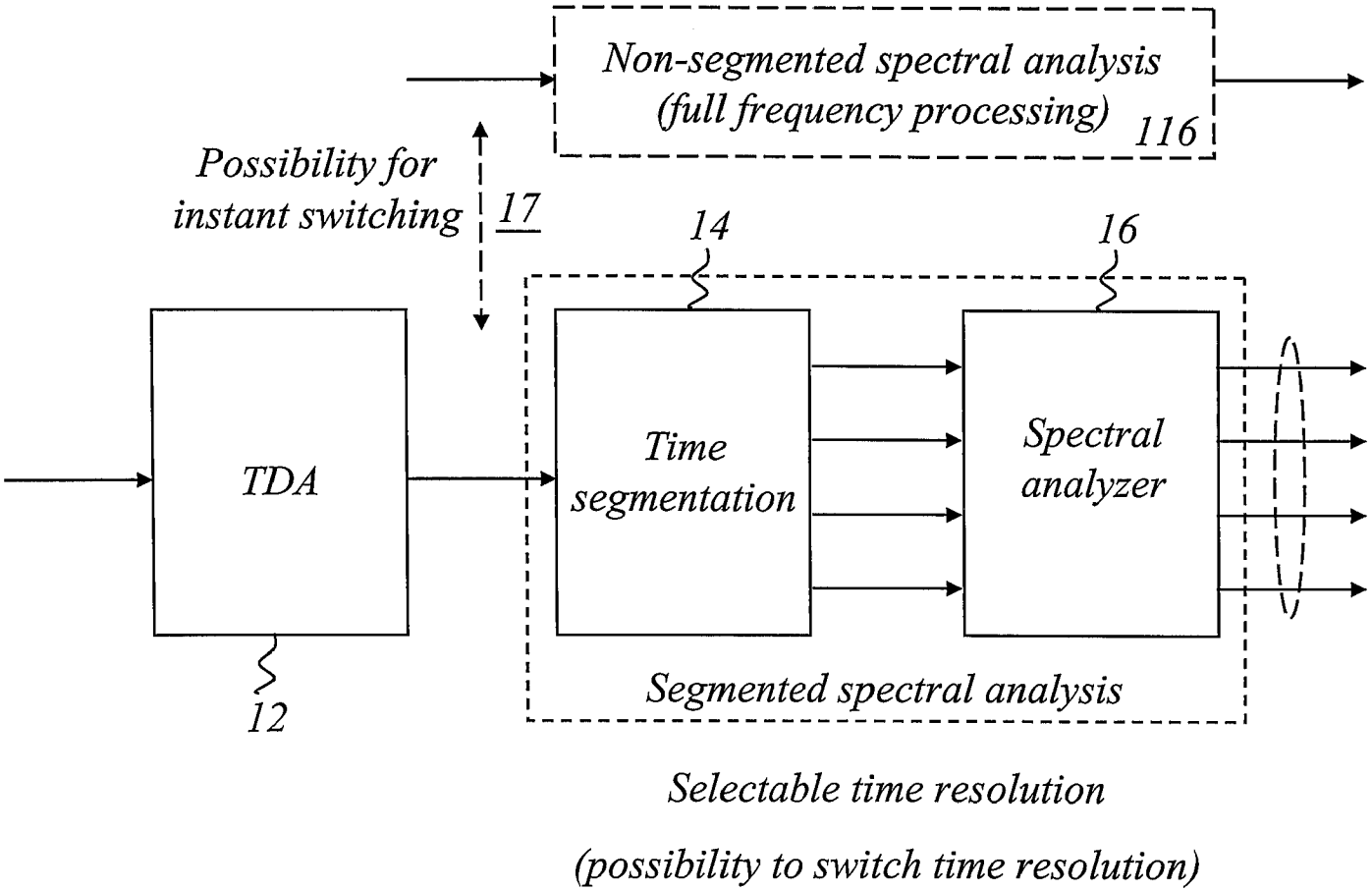
FIG. 7 is a schematic block diagram of a general signal processing device according to a preferred exemplary embodiment of the invention.

FIG. 7 is a schematic block diagram of a general signal processing device according to a preferred exemplary embodiment of the invention. The device basically comprises a time-domain aliasing (TDA) unit 12, a time segmentation unit 14 and a spectral analyzer 16. In the basic example of FIG. 7, a considered frame of a number of overlapped frames is time-domain aliased in the TDA unit 12 to generate a time-domain aliased frame, and the time segmentation unit 14 operates on the time-domain aliased frame to generate a number of time segments, also referred to as sub-frames. The spectral analyzer 16 is configured for segmented spectral analysis based on these segments to generate, for each segment, a set of spectral coefficients. The collective spectral coefficients of all segments represent a time-frequency tiling of the processed time-domain frame with a higher than normal time-resolution.

Since the invention utilizes a time-domain aliased frame as a basis for the spectral analysis, there is a possibility for instant switching between non-segmented spectral analysis based on the time-domain aliased frame, so-called full-frequency resolution processing and segmented spectral analysis based on relatively shorter segments, so-called increased time-resolution processing.

Preferably, such instant switching is performed by a switching functionality 17 in dependence on detection of a signal transient in the input signal. The transient may be detected in the time-domain, time-aliased domain or even in the frequency domain. Typically, a transient frame is processed with a higher time resolution than a stationary frame, which may then be processed using normal full-frequency processing.

There is also a possibility to switch time resolution instantly by using a higher or lower number of time segments for the spectral analysis.

Preferably, the time-domain aliasing, time segmentation and spectral analysis are repeated for each of a number of consecutive overlapped frames.

Figure 20:
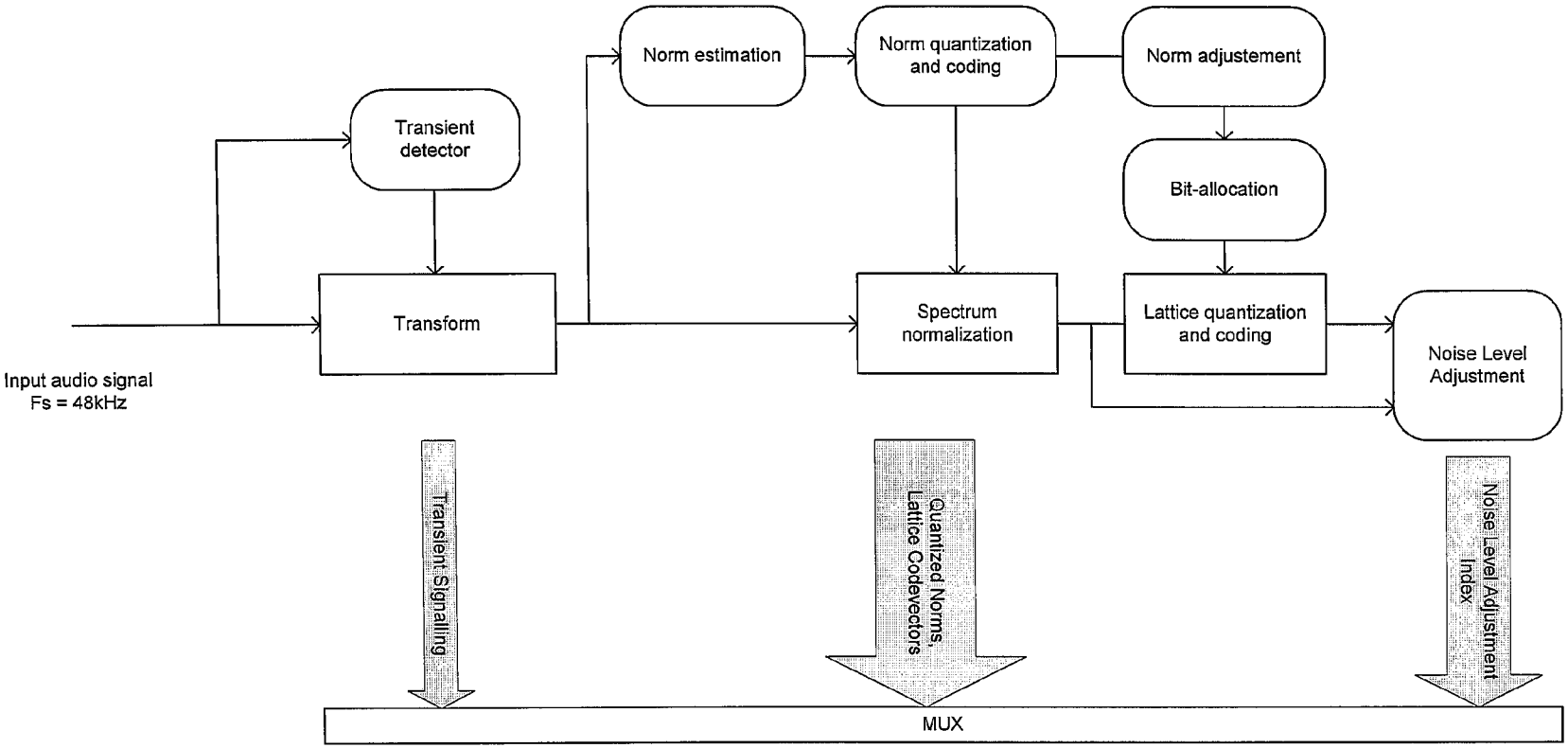
FIG. 20 is a block diagram of an exemplary encoder suitable for fullband extension.

In a preferred embodiment of the invention, the signal processing device of FIG. 7 is part of an audio coder such as the audio encoder 10 of FIG. 1 or FIG. 20 using transform coding for the spectral analysis.

Based on the above "forward" procedure, the chain of inverse operations for mapping a set of spectral coefficients to a time-domain frame is easily and naturally apparent to the skilled person.

Briefly, in a second aspect of the invention, inverse spectral analysis is performed based on different sub-sets of spectral coefficients in order to generate, for each sub-set of spectral coefficients, an inverse-transformed sub-frame, also referred to as a segment. Inverse time-segmentation is then performed based on overlapped inverse-transformed sub-frames to combine these sub-frames into a time-domain aliased frame, and inverse time-domain aliasing is performed based on the time-domain aliased frame to enable reconstruction of the time-domain signal.

The inverse time-domain aliasing is typically performed to reconstruct a first time-domain frame, and the overall procedure may then synthesize the time-domain signal based on overlap-adding the first time-domain frame with a subsequent second reconstructed time-domain frame. Reference can for example be made to the general overlap-add operations of FIG. 4B.

Preferably, the inverse signal processing includes at least one of signal synthesis and audio decoding. The inverse spectral analysis may be based on any of a number of different inverse transforms, preferably lapped transforms. For example, in audio decoding applications, it is beneficial to use the inverse MDCT transform.

A more detailed overview and explanation of the inverse chain of operations as well as preferred implementations will be discussed later on.

Figure 8:
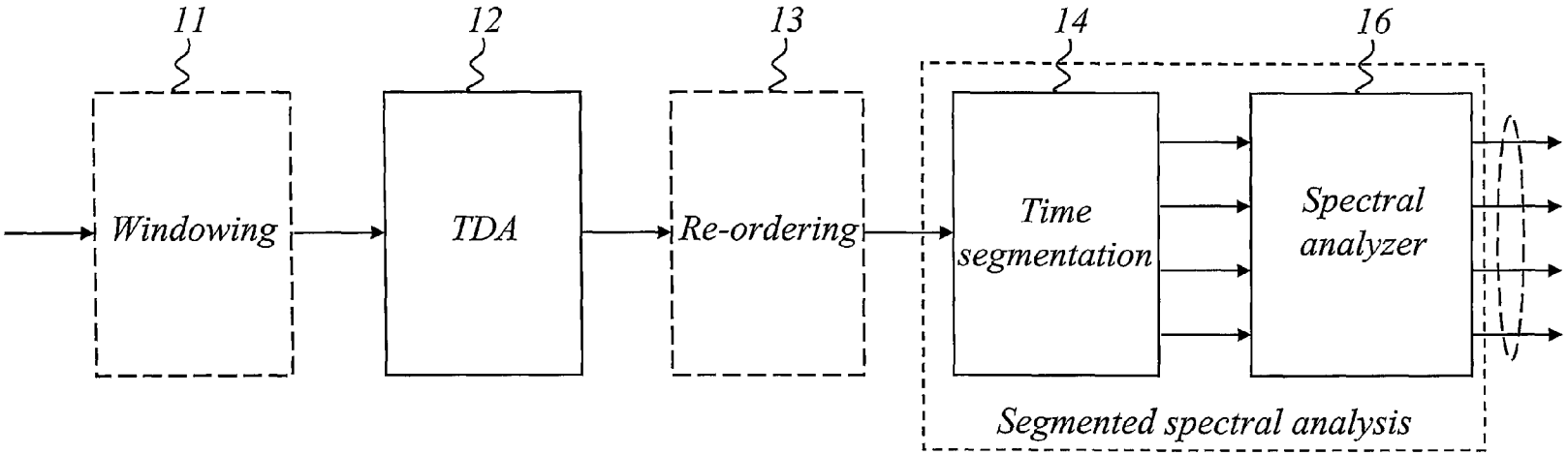
FIG. 8 is a schematic block diagram of a device according to another preferred exemplary embodiment of the invention.

FIG. 8 is a schematic block diagram of a device according to another preferred exemplary embodiment of the invention. In addition to the basic blocks of FIG. 7, the device of FIG. 8 further includes one or more optional processing units such as the windowing unit 11 and the re-ordering unit 13.

In the example of FIG. 8, the optional windowing unit 11 performs windowing based on one of the overlapped frames to generate a windowed frame, which is forwarded to the TDA unit 12 for time-domain aliasing. Basically, windowing may be performed to enhance the transform's frequency selectivity properties. The window shape can be optimized to fulfill certain frequency selectivity criteria, several optimization techniques can be used and are well known for those skilled in the art.

In order to maintain full temporal coherence of the input signal, it is beneficial to apply time-domain aliasing re-ordering. For this reason, an optional re-ordering unit 13 may be provided for re-ordering the time-domain aliased frame to generate a re-ordered time-domain aliased frame, which is forwarded to the segmentation unit 14. In this way, segmentation is performed based on the re-ordered time-domain aliased frame. The spectral analyzer 16 preferably operates on the generated segments from the time-segmentation unit 14 to obtain a segmented spectral analysis with a higher than normal time resolution.

Figure 9:
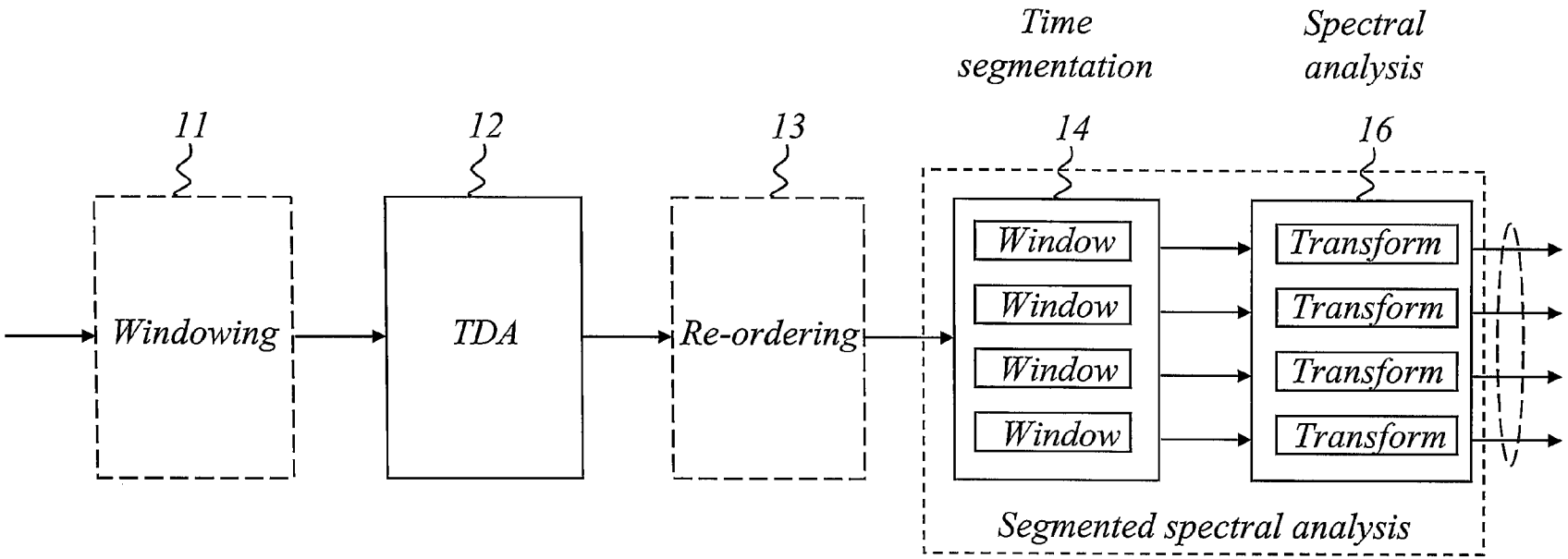
FIG. 9 is a schematic block diagram of a device according to yet another exemplary embodiment of the invention.

FIG. 9 is a schematic block diagram of a device according to yet another exemplary embodiment of the invention. The example of FIG. 9 is similar to that of FIG. 8, except that in FIG. 9 it is explicitly indicated that the time segmentation is based on a set of suitable window functions, and that the spectral analysis is based on applying transforms on segments of the (re-ordered) time-domain aliased frame.

In a particular example, the segmentation involves adding zero padding to the (re-ordered) time-domain aliased frame and dividing the resulting signal into relatively shorter and preferably overlapped segments.

Preferably, the spectral analysis is based on applying a lapped transform such as MDCT or MLT on each of said overlapped segments.

In the following, the invention will be described with reference to further exemplary and non-limiting embodiments.

As mentioned, the invention is based on the concept of using the time-aliased signal (output of the time domain aliasing operation) as a new signal frame on which spectral analysis is applied. By changing the temporal resolution of the transform which is applied after time aliasing in order to obtain the (e.g. MDCT) coefficient, e.g. the $DCT_{IV}$, the invention allows to obtain a spectral analysis on arbitrary time segments with very little overhead in complexity as well as instantaneously, i.e. without additional delay.

In order to obtain a signal analysis with a predetermined time resolution it is sufficient to directly apply the appropriate lengths orthogonal transforms on preferably overlapped segments of the time-aliased windowed input signal.

The output of each of these shorter length transforms will lead to a set of coefficients representative of the frequency content of each segment in question. The set of coefficients for all segments will instantaneously provide an arbitrary time-frequency tiling of the original signal frame.

This instantaneous decomposition can be used in order to mitigate the pre-echo effect, for instance in the case of transients, as well as provide an efficient representation of the signal which allows a bit-rate efficient encoding of the frame in question.

The overlapped segments of the time-aliased windowed signal need not to be of equal length. Because of the correspondence in time between segments in the time aliased domain and the normal time domain, the desired level of time resolution analysis will determine the number of segments as well as the length of each segments on which the frequency analysis is performed.

The invention is best applied together with a transient detector and/or in the context of coding by measuring the coding gain obtained for a given set of time segmentations, this include both open-loop and closed-loop coding gain estimations for each time segmentation trial.

The invention is for example useful together with the ITU-T G.722.1 standard, and especially for the "ITU-T G.722.1 fullband extension for 20 kHz full-band audio" standard, now renamed ITU-T G.719 standard, both for encoding and decoding, as will be exemplified later on.

The invention allows an instantaneous switching of the time resolution of the overall transform (e.g. based on MDCT). Thus, contrary to window switching, the invention does not require any delay.

The invention has very low complexity and no additional filter bank is needed. The invention preferably uses the same transform as the MDCT, namely the type IV DCT.

The invention efficiently handles pre-echo artifact suppression by instantaneously switching to higher time resolution.

The invention would also allow to build closed/open-loop coding schemes based on signal adaptive time segmentations.

For a better understanding of the invention, more detailed examples of individual (possibly optional) signal processing operations as well as further examples of overall implementations will now be described. The spectral analysis will mainly be described with reference to the MDCT transform in the following, but it should be understood that the invention is not limited thereto, although the use of a lapped transform is beneficial.

If there are strict requirements on temporal coherence, so-called re-ordering is recommended.

TDA Reordering

Figure 10:
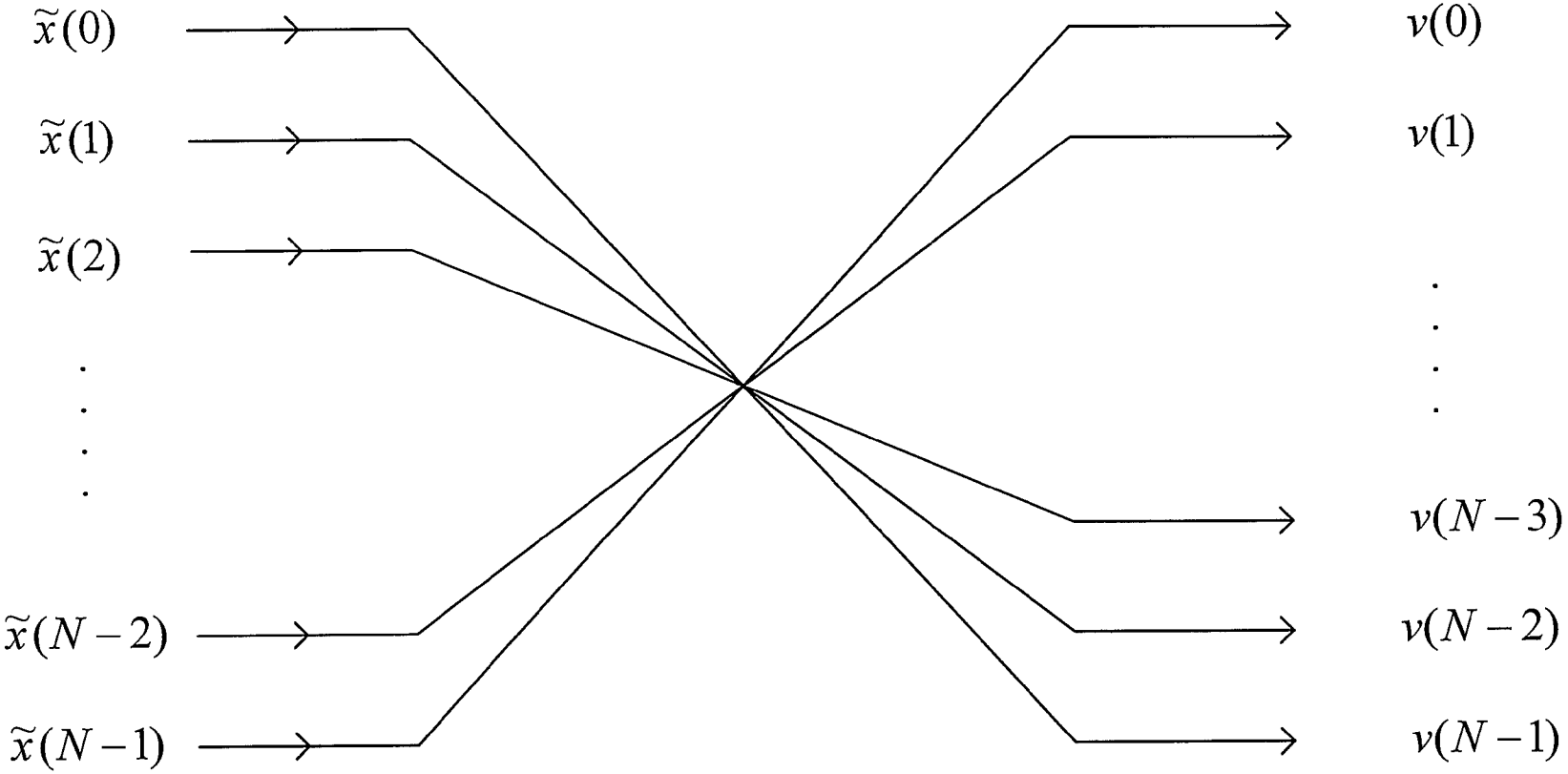
FIG. 10 is a schematic diagram of an example of time-domain aliasing re-ordering according to an exemplary embodiment of the invention.

In order to keep the temporal coherence of the input signal, the output of the time domain aliasing operation needs to be re-ordered before further processing. The ordering operation is necessary, without ordering the basis functions of the resulting filter-bank will have an incoherent time and frequency responses. An example of a reordering operation is illustrated in FIG. 10, and involves shuffling the upper and lower half of the TDA output signal $\tilde{x}(n)$. This reordering is only conceptual and in reality no computations are involved. The invention is not limited to the example shown in FIG. 10. Of course, other types of re-ordering can be implemented.

Simple Embodiment

Improving the Time Resolution

A first simple embodiment shows how to double the time resolution according to the present invention. Accordingly, a time-frequency analysis is applied to v(n), in order to double the time resolution, v(n) is split into two preferably overlapping segments. Because v(n) is a time limited signal, an amount of zero padding is added at the start and end of v(n). Preferably, the input signal is a reordered time aliased windowed signal, of length N. The length of zero padding is dependent on the length of the signal v(n) and the desired amount of segments, in this case since two overlapped segment are desired the length of zero padding is equal to a quarter of the length of v(n) and are appended at the start and end of v(n). Using such zero padding leads to two 50%-overlapped segments of the same length as the length of v(n).

Figure 11:
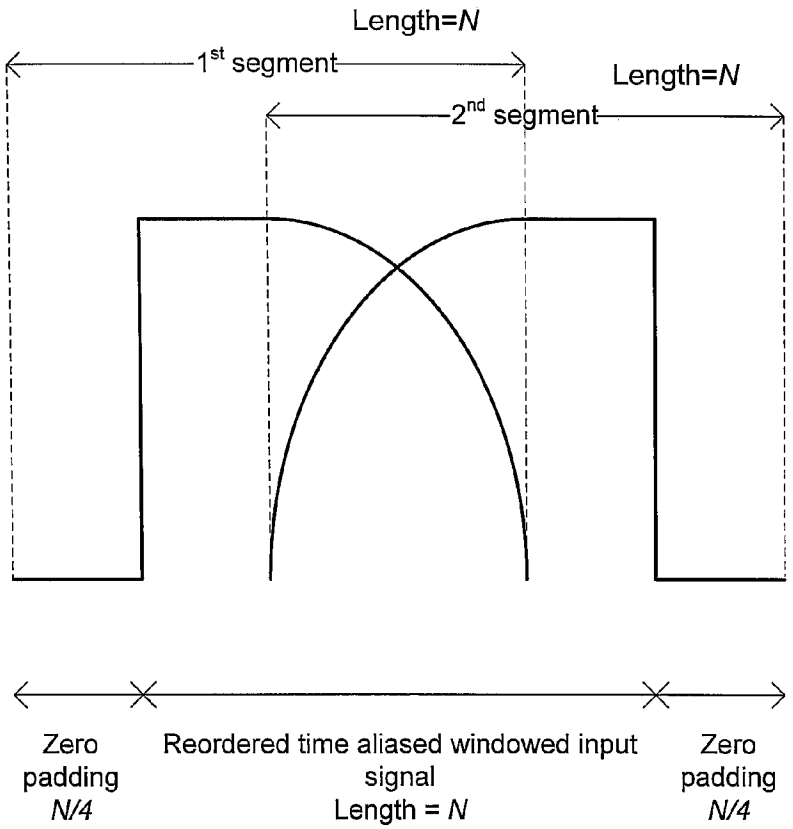
FIG. 11 is a schematic diagram illustrating an example of segmentation into two time segments, including zero padding, according to an exemplary embodiment of the invention.

Preferably the resulting overlapped segments are windowed, as exemplified in FIG. 11. It should be noted that while the window shape can, to a certain extent, be optimized for the desired application, it has to obey the perfect reconstruction constraints. This can be seen in FIG. 11, where the right half of the window of the $2^{nd}$ segment has a value 1 for the part that applies to the signal v(n) and the value 0 for the appended zero padding.

Each of the obtained segments has a length of exactly N. Applying the MDCT on each segment leads to N/2 coefficients; i.e. a total of N coefficients, hence the resulting filter bank is critically sampled, see FIG. 11. Because of the constraints on the window shapes, the operation is invertible and applying the inverse operations on the two sets of MDCT coefficients (MDCT coefficients of segment 1 and 2) will lead back to the signal v(n).

For this embodiment, the resulting filter-bank basis functions have improved time localization but loose in frequency localization, which is a well known effect from the time-frequency uncertainty principle.

Figure 12:
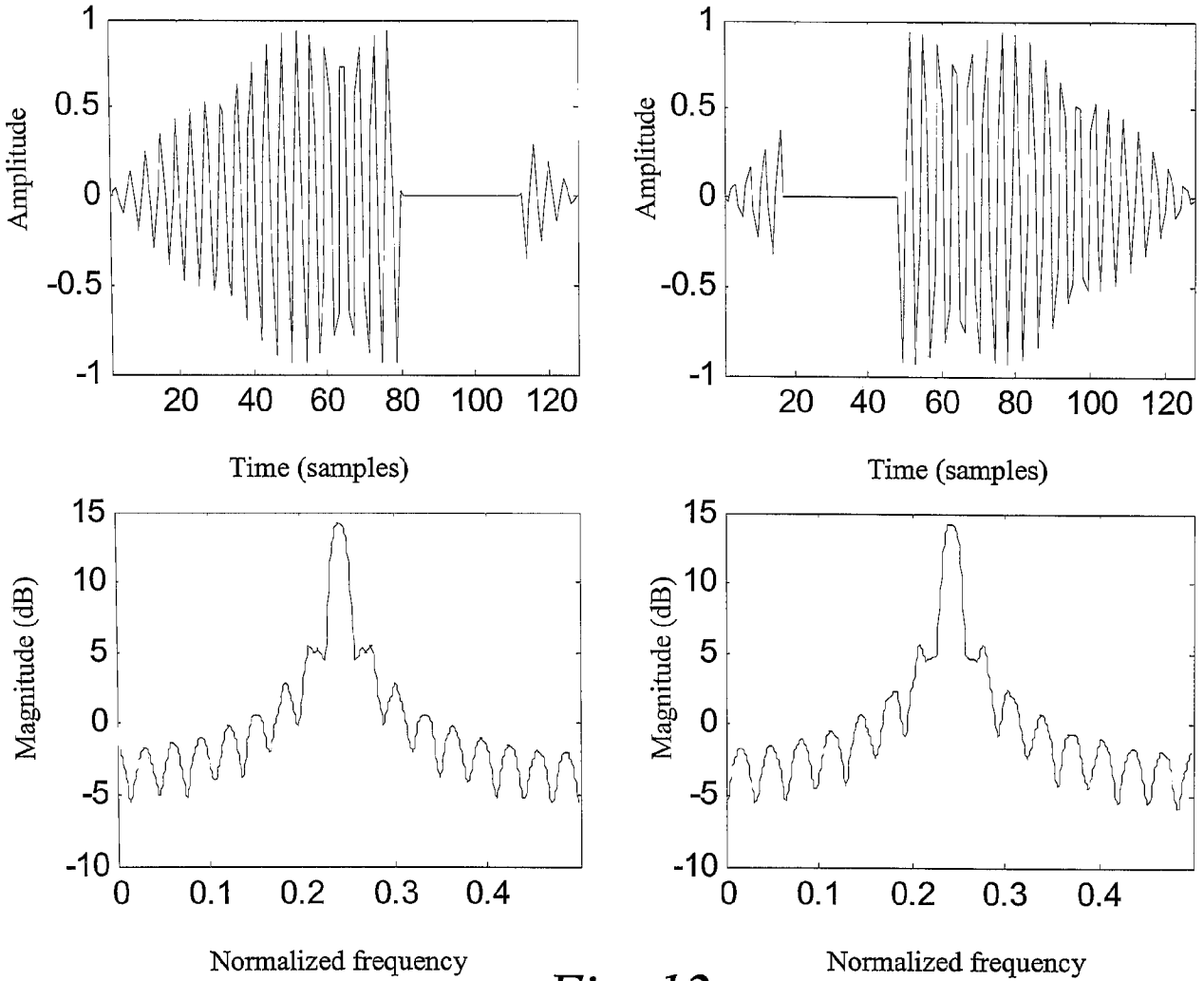
FIG. 12 shows diagrams of the two basis functions for the segmentation of FIG. 11 which relate to a normalized frequency of 0.25 together with corresponding frequency response diagrams.
Figure 13:
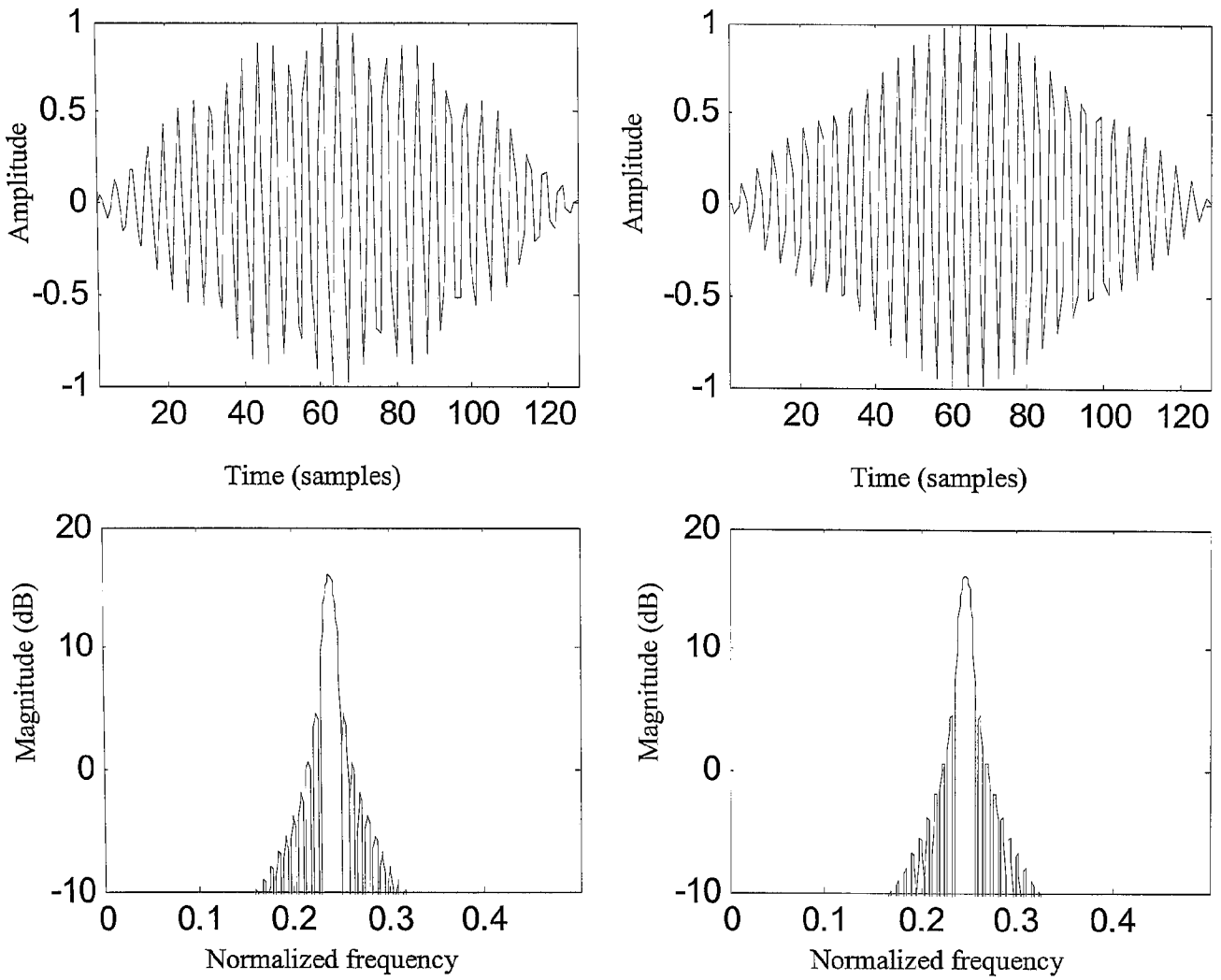
FIG. 13 shows diagrams of the original MDCT basis functions related to the normalized frequency of 0.25 together with corresponding frequency response diagrams.

FIG. 12 shows the two basis functions which relate to the normalized frequency 0.25. Clearly, the time spread is much limited, however, it is also seen that there is a spilling in time spread which is due to overlapping the two sections of the time-aliased signal. This spilling in the time domain is an effect of the time-domain aliasing cancellation and would always be present. However, it can be mitigated by a proper choice (numerical optimization) of the windowing functions. FIG. 12 also shows the frequency responses. As a comparison, the original MDCT basis functions are shown in FIG. 13, these correspond to a much narrower sampling of the frequency domain however, and their time span is much broader. FIG. 13 shows the original basis functions corresponding to the MLT filterbank (MDCT+sine window).

Higher Time Resolutions

Figure 14:
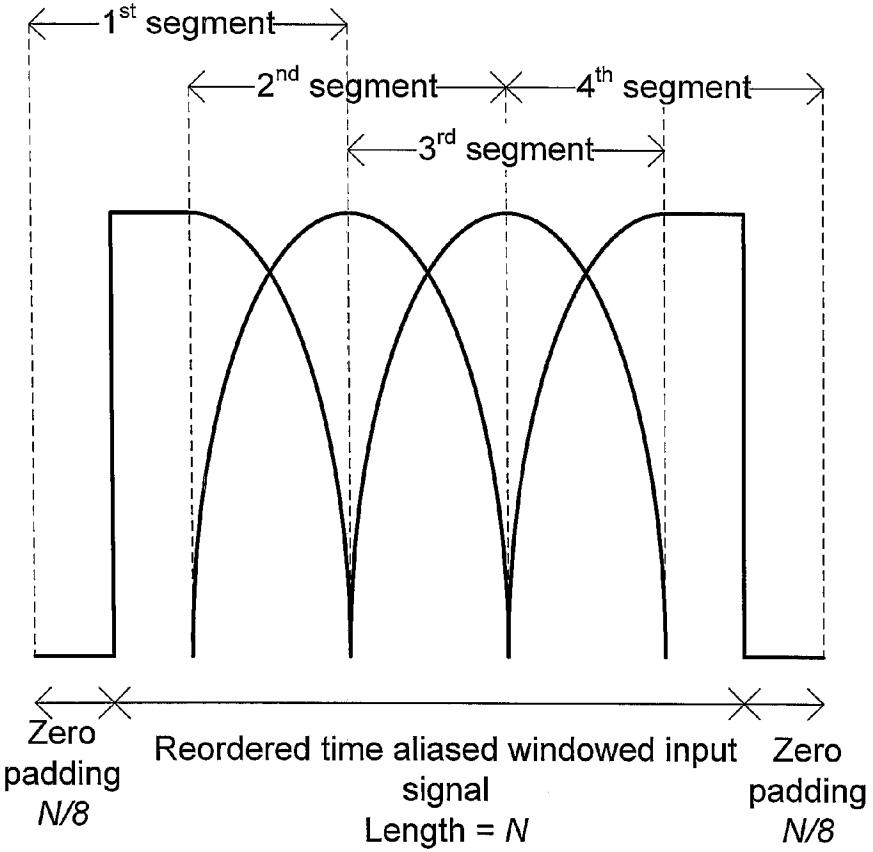
FIG. 14 is a schematic diagram illustrating an example of segmentation into four time segments, including zero padding, according to an exemplary embodiment of the invention.
Figure 15:
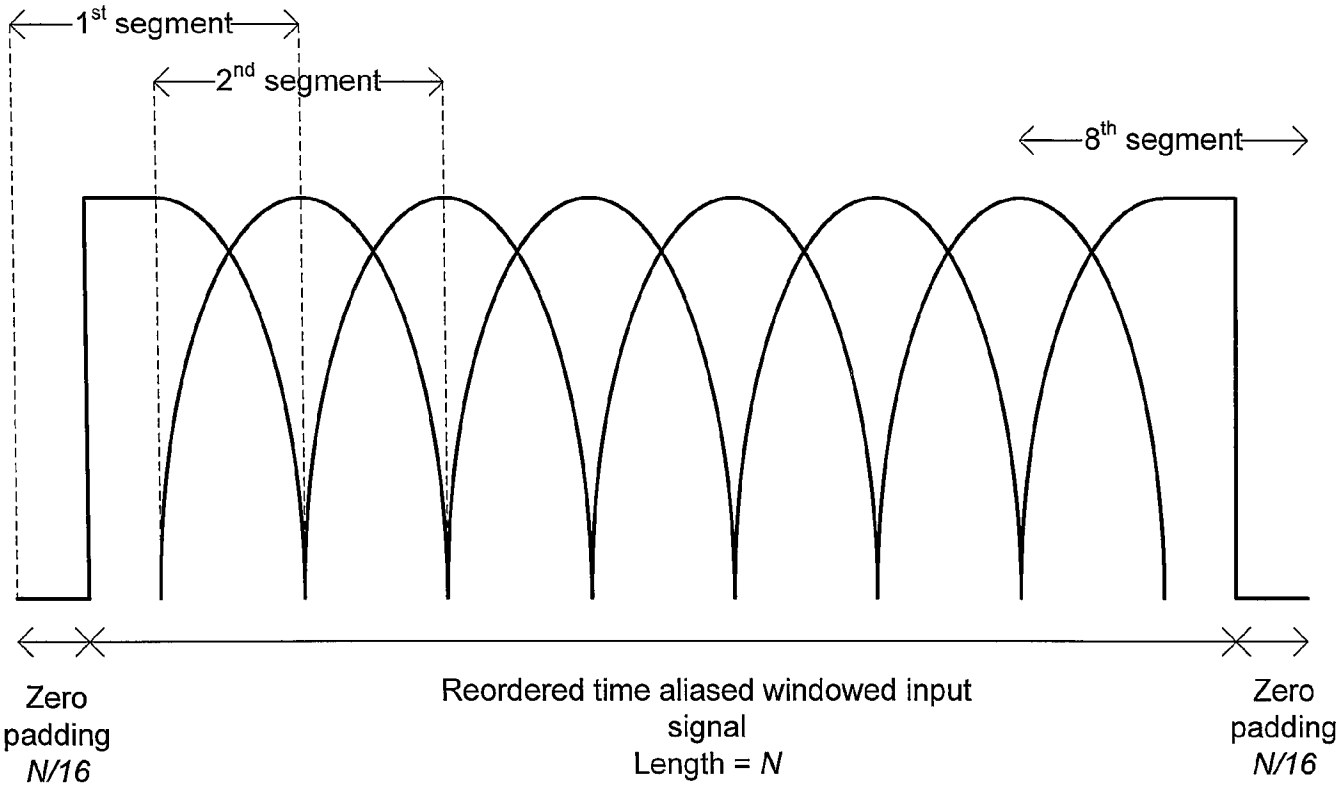
FIG. 15 is a schematic diagram illustrating an example of segmentation into eight time segments, including zero padding, according to an exemplary embodiment of the invention.

Higher time resolution can be obtained by dividing the reordered time aliased signal into more segments. FIGS. 14 and 15 show how this is achieved for four and eight segments, respectively. FIG. 14 illustrates a higher time resolution by division into four segments, and FIG. 15 illustrates a higher time resolution by division into eight segments. As should be understood, any suitable number of time segments can be used, depending on the desired time resolution.

In general, the time-segmentation unit is configured to generate a selectable number N of segments based on a time-domain aliased frame, where N is an integer equal to or greater than 2.

Figure 16:
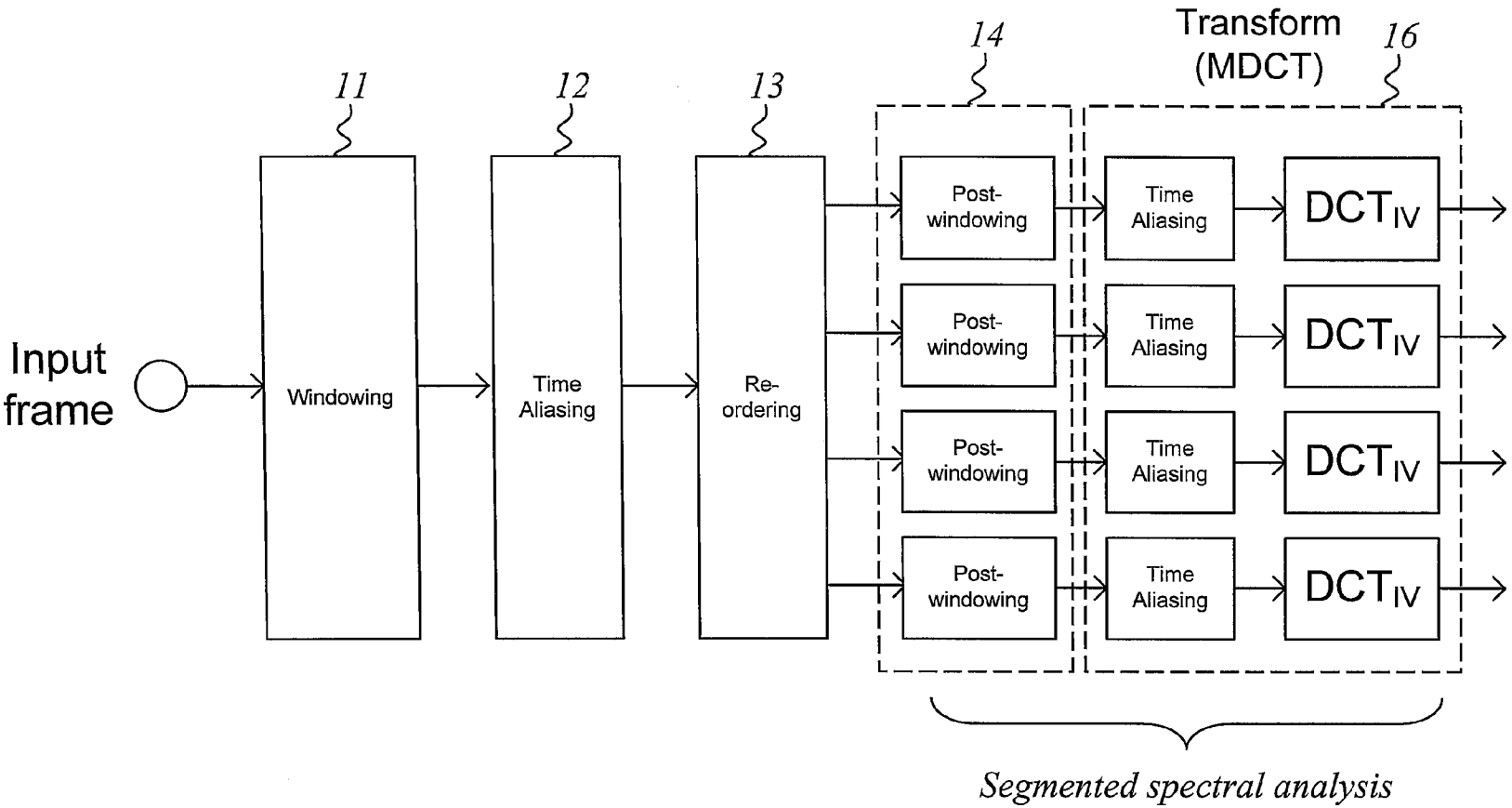
FIG. 16 shows a realization of a resulting overall transform for the case of four segments, according to an exemplary embodiment of the invention.

For the case of four segments, FIG. 16 shows a realization of the resulting overall transform. Windowing of an input frame is performed in a windowing unit 11, time-aliasing is performed in a time-domain aliasing unit 12, and optional re-ordering is performed in the re-ordering unit 13. Segmented spectral analysis is then performed by applying post-windowing on four segments using post-windowing units 14 and segmented transforms by transform units 16. Preferably, the overall segmented transform is based on segmented MDCT, using time-aliasing and $DCT_{IV}$ for each segment.

Non-Uniform Time Domain Tiling

With this invention it is also possible to obtain non-uniform time segmentations according to the same concept. There are at least two possible ways to perform such an operation. A first method is based on a non-uniform time segmentation of the reordered time aliased signal. Thus the windows used to segment the signal have different lengths.

A second method is based on a hierarchical approach. The idea is to first apply coarse time segmentation and then to further re-apply the invention of the resulting coarse segments until the desired tiling is obtained.

Figure 17:
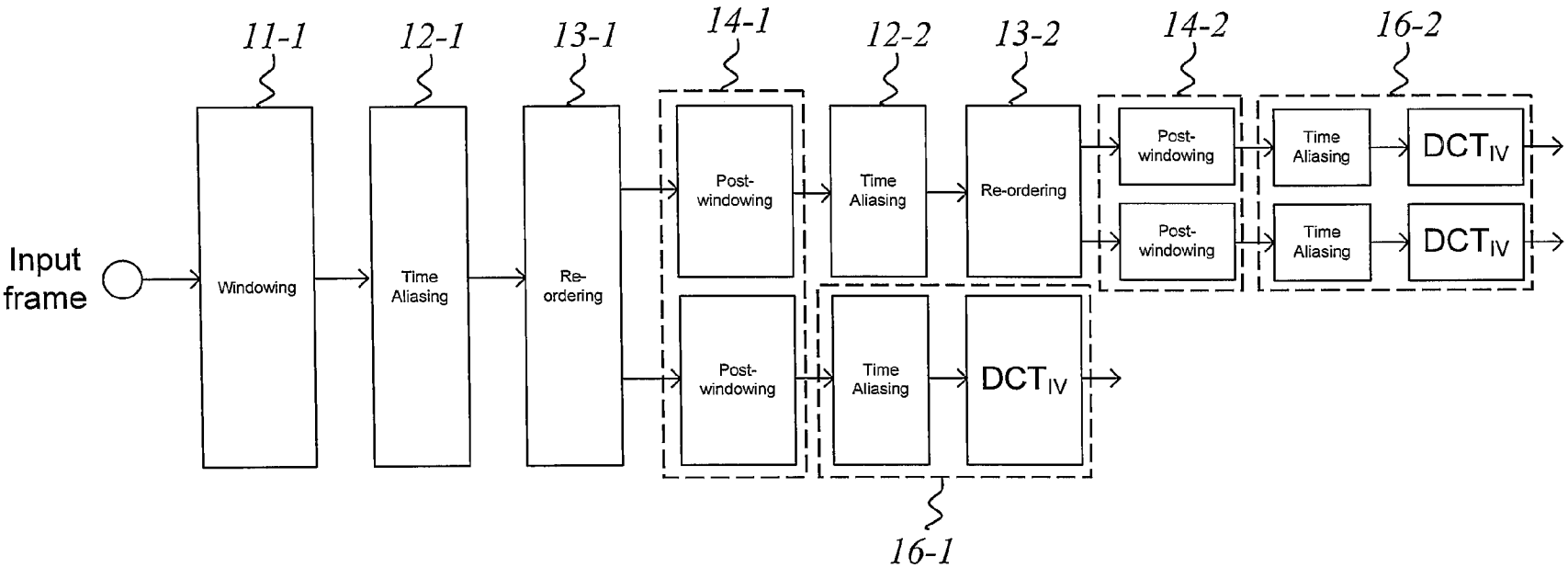
FIG. 17 illustrates an exemplary way of obtaining a non-uniform segmentation by means of a hierarchical approach.

FIG. 17 shows an example of how this second method can be implemented. For this example, first the signal is split into two time segments according to the present invention; afterwards one of the segments is further split into two segments. An example of a suitable transform is the MDCT transform, using time-aliasing and $DCT_{IV}$ for each considered segment.

Operation with Transient Detection

Figure 18:
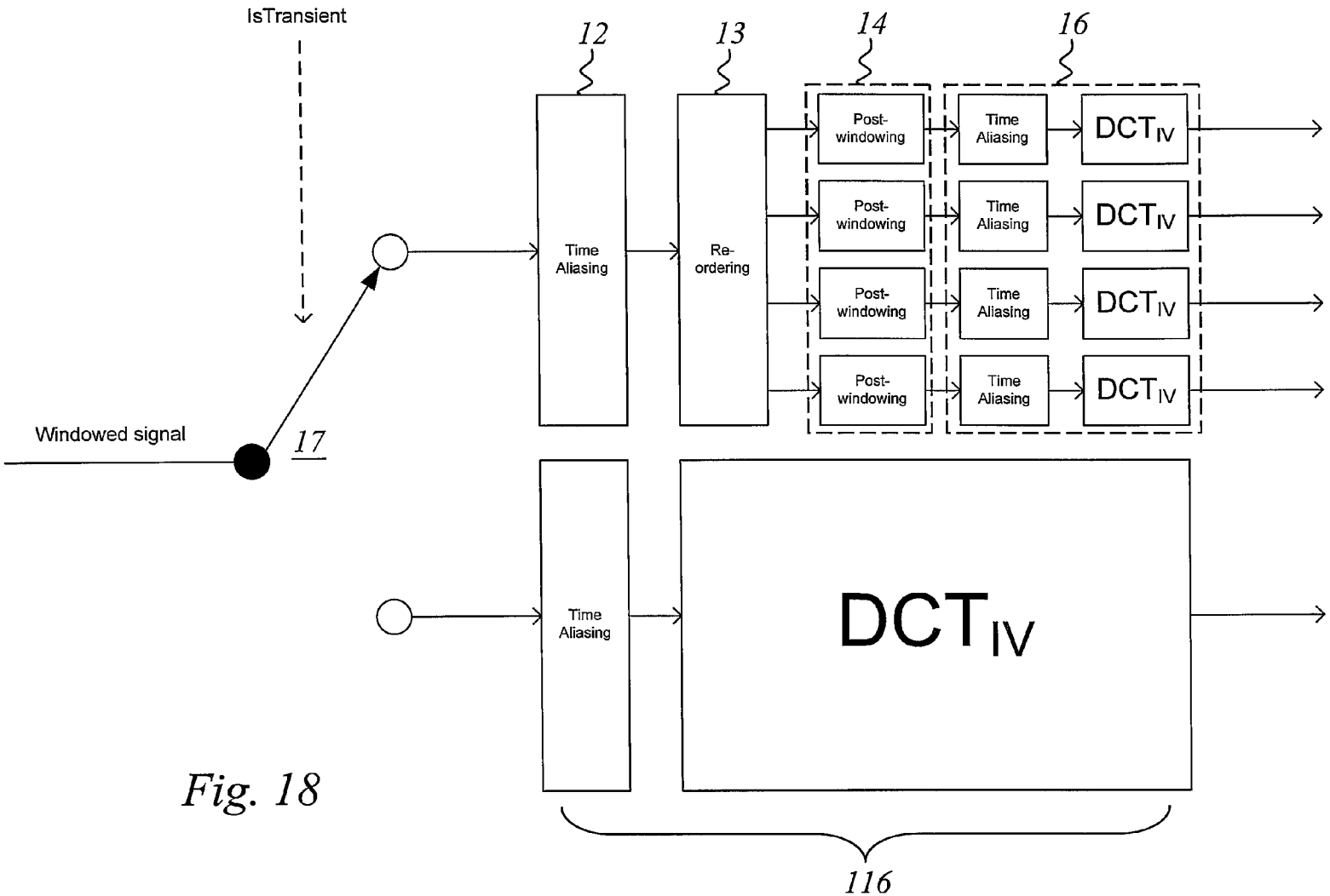
FIG. 18 illustrates an example of instant switching to a finer time resolution upon detection of a transient.

The invention can be used in order to mitigate the pre-echo artifacts and is in this case best associated with a transient detector, as exemplified in FIG. 18. Upon detection of a transient, the transient detector would set a flag (IsTransient). The transient detector flag would then use the switch mechanism 17 to switch instantly from a normal full frequency resolution processing (non-segmented spectral analysis) to higher time resolution (segmented spectral analysis) as depicted in FIG. 18. With this embodiment it is possible then to analyze transient signals with a much finer time resolution thus eliminating the annoying pre-echo artifacts.

Close Loop/Closed Loop Coding Operations

The invention can also be used as a mean to find the optimal time-frequency tiling for the analysis of a signal prior to coding. Two exemplary modes of operation can be used, closed loop and open loop. In open-loop operation an external device would decide of the best (in terms of coding efficiency) time-frequency tiling for a given signal frame and use the invention in order to analyze the signal according to the optimal tiling. In closed loop operation, a set of predefined tilings are used, for each of these tilings the signal is analyzed and encoded according to the tiling. For each tiling a measure of fidelity is computed. The tiling leading to the best fidelity is selected.

The selected tiling together with the encoded coefficients corresponding to this tiling is transmitted to the decoder.

As mentioned, the above-described principles and concepts for the forward procedure allow a person skilled in the art to realize an inverse chain of operations in an inverse procedure.

Figure 19:
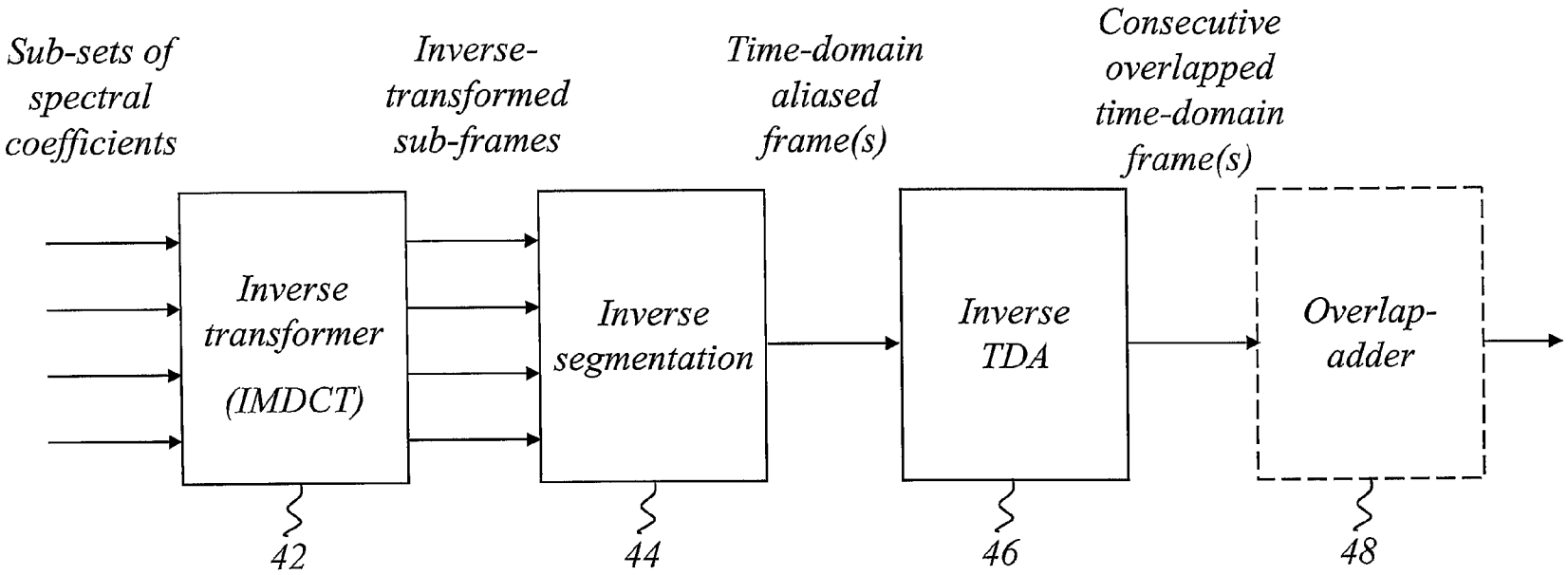
FIG. 19 is a block diagram illustrating a basic example of a signal processing device for operating based on spectral coefficients representative of a time-domain signal.

FIG. 19 is a block diagram illustrating a basic example of a signal processing device for operating based on spectral coefficients representative of a time-domain signal. The device includes an inverse transformer 42, a unit 44 for inverse time segmentation, an inverse TDA unit 46, and an optional overlap-adder 48.

Basically, it is desirable to synthesize a time-domain signal from a quantized and coded bit-stream. Once, spectral coefficients have been retrieved, inverse spectral analysis is performed in the inverse transformer 42 based on different subsets of spectral coefficients in order to generate, for each sub-set of spectral coefficients, an inverse-transformed subframe, also referred to as a segment. The unit 44 for inverse time-segmentation operates based on overlapped inverse-transformed sub-frames to combine these sub-frames into a time-domain aliased frame. The inverse TDA unit 46 then performs inverse time-domain aliasing based on the time-domain aliased frame to enable reconstruction of the time-domain signal.

The inverse time-domain aliasing is typically performed to reconstruct a first time-domain frame, and the overall procedure may then synthesize the time-domain signal based on overlap-adding the first time-domain frame with a subsequent second reconstructed time-domain frame, by using the overlap-adder 48.

Optional pre-, mid- and post-processing stages may be included in the device of FIG. 19.

The inverse spectral analysis may be based on any of a number of different inverse transforms, preferably lapped transforms. For example, in audio decoding applications, it is beneficial to use the inverse MDCT transform (IMDCT).

Preferably, signal processing device is configured for signal synthesis and/or audio decoding to reconstruct a time-domain audio signal. In a preferred embodiment of the invention, the signal processing device of FIG. 19 is part of an audio decoder such as the audio decoder 40 of FIG. 1 or FIG. 21.

In the following, the invention will be described in relation to a specific exemplary and non-limiting codec realization suitable for the ITU-T G.722.1 fullband codec extension, namely the ITU-T G.719 codec. In this particular example, the codec is presented as a low-complexity transform-based audio codec, which preferably operates at a sampling rate of 48 kHz and offers full audio bandwidth ranging from 20 Hz up to 20 kHz. The encoder processes input 16-bits linear PCM signals in frames of 20 ms and the codec has an overall delay of 40 ms. The coding algorithm is preferably based on transform coding with adaptive time-resolution, adaptive bit-allocation and low-complexity lattice vector quantization. In addition, the decoder may replace non-coded spectrum components by either signal adaptive noise-fill or bandwidth extension.

FIG. 20 is a block diagram of an exemplary encoder suitable for fullband extension. The input signal sampled at 48 kHz is processed through a transient detector. Depending on the detection of a transient, a high frequency resolution or a low frequency resolution (high time resolution) transform is applied on the input signal frame. The adaptive transform is preferably based on a Modified Discrete Cosine Transform (MDCT) in case of stationary frames. For non-stationary frames a higher temporal resolution transform is used without a need for additional delay and with very little overhead in complexity. Non-stationary frames preferably have a temporal resolution equivalent to 5 ms frames (although any arbitrary resolution can be selected).

It may be beneficial to group the obtained spectral coefficients into bands of unequal lengths. The norm of each band is estimated and the resulting spectral envelope consisting of the norms of all bands is quantized and encoded. The coefficients are then normalized by the quantized norms. The quantized norms are further adjusted based on adaptive spectral weighting and used as input for bit allocation. The normalized spectral coefficients are lattice vector quantized and encoded based on the allocated bits for each frequency band. The level of the non-coded spectral coefficients is estimated, coded and transmitted to the decoder. Huffman encoding is preferably applied to quantization indices for both the coded spectral coefficients as well as the encoded norms.

Figure 21:
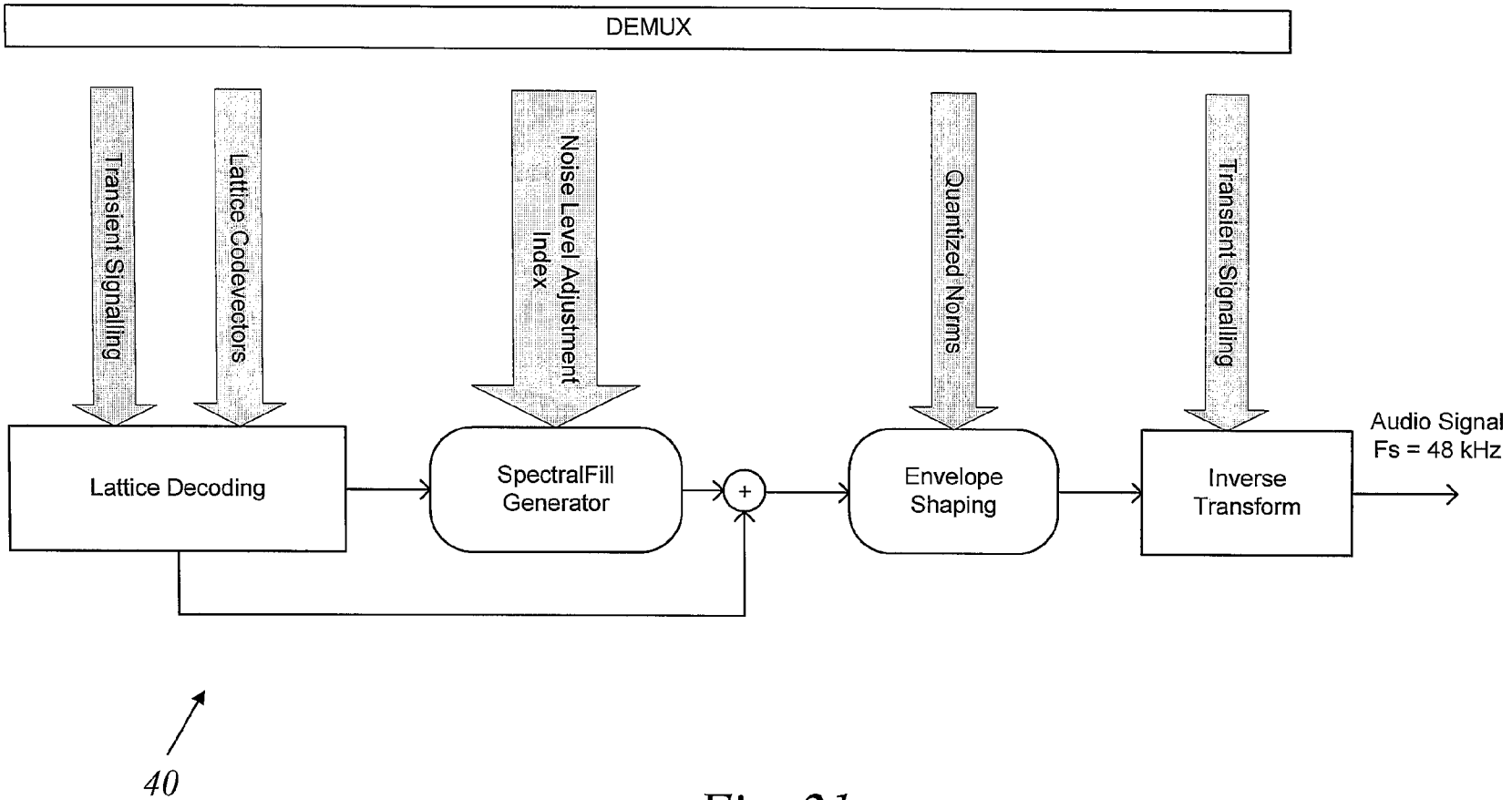
FIG. 21 is a block diagram of an exemplary decoder suitable for fullband extension.

FIG. 21 is a block diagram of an exemplary decoder suitable for fullband extension. The transient flag is first decoded which indicates the frame configuration, i.e. stationary or transient. The spectral envelope is decoded and the same, bit-exact, norm adjustments and bit-allocation algorithms are used at the decoder to recompute the bit-allocation which is essential for decoding quantization indices of the normalized transform coefficients.

After de-quantization, low frequency non-coded spectral coefficients (allocated zero bits) are regenerated, preferably by using a spectral-fill codebook built from the received spectral coefficients (spectral coefficients with non-zero bit allocation).

Noise level adjustment index may be used to adjust the level of the regenerated coefficients. High frequency non-coded spectral coefficients are preferably regenerated using bandwidth extension.

The decoded spectral coefficients and regenerated spectral coefficients are mixed and lead to a normalized spectrum. The decoded spectral envelope is applied leading to the decoded full-band spectrum.

Finally, the inverse transform is applied to recover the time-domain decoded signal. This is preferably performed by applying either the inverse Modified Discrete Cosine Transform (IMDCT) for stationary modes, or the inverse of the higher temporal resolution transform for transient mode.

The algorithm adapted for fullband extension is based on adaptive transform-coding technology. It operates on 20 ms frames of input and output audio. Because the transform window (basis function length) is of 40 ms and a 50 percent overlap is used between successive input and output frames, the effective look-ahead buffer size is 20 ms. Hence, the overall algorithmic delay is of 40 ms which is the sum of the frame size plus the look-ahead size. All other additional delays experienced in use of a G.722.1 fullband codec are either due to computational and/or network transmission delays.

Figure 22:
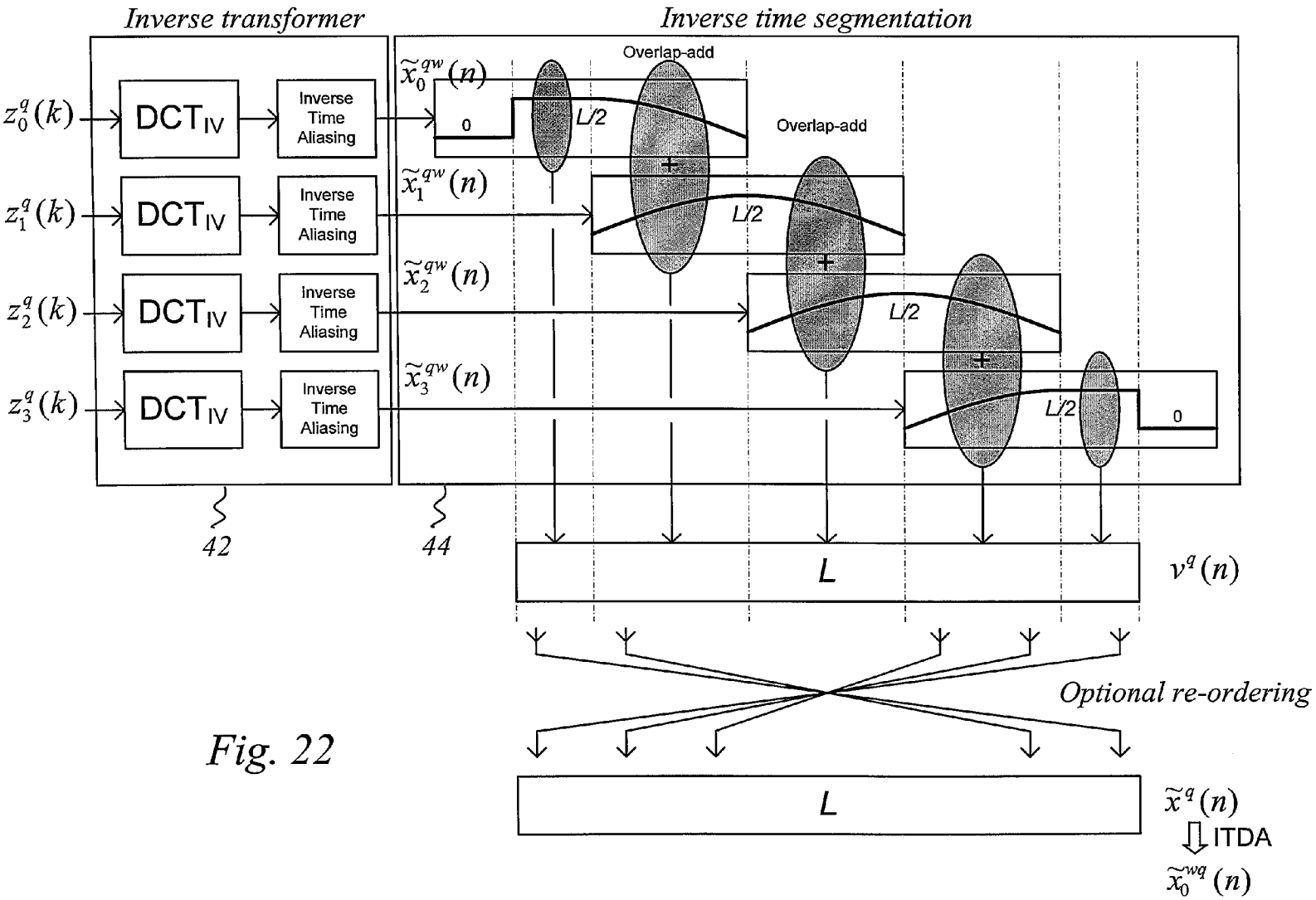
FIG. 22 is a schematic block diagram of a particular example of an inverse transformer and associated implementation for inverse time segmentation and optional re-ordering according to a preferred embodiment of the invention.

FIG. 22 is a schematic block diagram of a particular example of an inverse transformer and associated implementation for inverse time segmentation and optional re-ordering according to a preferred embodiment of the invention. The inverse transformer is based on $DCT_{IV}$ in cascade with inverse time aliasing. Four so-called sub-spectra $z_l^q(k)$, where l=0, 1, 2, 3, are processed by the inverse transformer, and each sub-spectrum is first inverse-transformed by means of a respective $DCT_{IV}$ into the time domain aliased domain, and then inverse time aliased, i.e. inverse time domain aliased, to provide an overall inverse MDCT type transform for each sub-spectrum.

The length of the resulting signal $\tilde{x}_l^{qw}$ for each sub-frame index l is equal to double the length of the input spectrum, i.e. L/2.

The resulting inverse time domain aliased signals for each sub-frame l are windowed using the same configuration of windows as those in the encoder. The resulting windowed signals are overlapped added. Note that the window for the first m=0 and last m=3 sub-frame is zero. This is due to the zero padding that is used in the encoder.

These two frame edges do need to be computed and are effectively dropped. The resulting signal of the overlap-add operations of all sub-frames $v^q(n)$ is re-ordered using the inverse operation performed in the encoder, which leads to the signal $\tilde{x}^q(n)$, n=0, . . . , L−1.

The output of the inverse transform, in stationary or transient mode is of length L. Prior to windowing (not shown in FIG. 22) the signal is first inverse time domain aliased (ITDA) leading to a signal of length 2L according to:

$$\tilde{x}^{wq} = \begin{bmatrix} 0 & I_{L/2} \\ 0 & -J_{L/2} \\ -J_{L/2} & 0 \\ -I_{L/2} & 0 \end{bmatrix} \tilde{x}^q$$

The resulting signal is windowed for each frame r according to:

$$\tilde{x}^{(r)} = h(n)\tilde{x}_{(r)}^{wq}(n),\ n=0, \ldots, 2L-1,$$

where h(n) is a window function.

Finally the output fullband signal is constructed by overlap adding the signals $\tilde{x}^{(r)}(n)$ for two successive frames:

$$x^{(r)}(n) = \tilde{x}^{(r-1)}(n+L) + \tilde{x}^{(r)}(n),\ n=0, \ldots, 2L-1.$$

The embodiments described above are merely given as examples, and it should be understood that the present invention is not limited thereto. Further modifications, changes and improvements which retain the basic underlying principles disclosed and claimed herein are within the scope of the invention.

REFERENCES

[1] B. Edler, "Codierung von Audiosignalen mit uberlappender Transformation and adaptiven Fensterfunktionen" Frequenz, pp. 252-256, 1989.

[2]H. Malvar, "Lapped Transforms for efficient transform/subband coding". IEEE Trans. Acous., Speech, and Sig. Process., vol. 38, no. 6, pp. 969-978, June 1990.

[3] J. Herre and J. D. Johnston, "Enhancing the performance of perceptual audio coders by using temporal noise shaping (TNS)", in Proc. 101$^{st}$ Cony. Aud. Eng. Soc., preprint #4384, November 1996.

The invention claimed is:

1. A method for signal processing operating on overlapped frames of a time-domain input signal, said method comprising the steps of:

performing time-domain aliasing (TDA) based on an overlapped frame, having a length 2N, to generate a corresponding time-domain aliased frame having a length N;

performing segmentation in time based on the time-domain aliased frame of length N to generate at least two overlapped segments by producing a frame having a length larger than N based on the time-domain aliased frame and then dividing the resulting produced frame into overlapped segments each having a length equal to or smaller than N; and performing spectral analysis based on said at least two overlapped segments by applying, on each of said at least two overlapped segments, a transform adapted for the segment to obtain, for each segment, a corresponding set of coefficients representative of the frequency content of the segment.

2. The method of claim 1, wherein said signal processing includes at least one of signal analysis, signal compression and audio coding.

3. The method of claim 1, wherein said step of performing spectral analysis involves transform coding and comprises the step of applying a Modified Discrete Cosine Transform (MDCT) on each of said at least two segments, said MDCT being formed by a time domain aliasing operation (TDA) stage followed by a second stage based on a type IV Discrete Cosine Transform (DCT), and each segment has a length smaller than N.

4. The method of claim 1, wherein said step of performing spectral analysis involves transform coding and comprises the step of applying a transform on each of said at least two segments, wherein said transform includes at least one of a Lapped Transform (L T), a Discrete Cosine Transform (DCT), a Modified Discrete Cosine Transform (MDCT), and a Modulated Lapped Transform (MLT).

5. The method of claim 1, comprising the step of switching, in dependence on detection of a signal transient in said input signal, between:

non-segmented spectral analysis based on said time-domain aliased frame, so-called full- frequency resolution processing; and segmented spectral analysis based on said at least two segments, so-called increased time- resolution processing.

6. The method of claim 1, comprising the step of switching time resolution of said segmented spectral analysis.

7. The method of claim 1, wherein said step of performing segmentation is performed to generate at least one of the following types of segments:

overlapped segments, non-uniform length segments, and uniform length segments.

8. The method of claim 1, wherein said step of performing segmentation comprises the step of performing segmentation in time based on the time-domain aliased frame to generate a selectable number of overlapped segments, and said step of performing spectral analysis comprises the step of applying a lapped transform on each of said overlapped segments.

9. The method of claim 1, comprising the step of re-ordering the time-domain aliased frame to generate a re-ordered time-domain aliased frame, and said step of performing segmentation is based on the re-ordered time-domain aliased frame.

10. The method of claim 9, wherein said step of performing segmentation comprises the step of adding zero padding to the re-ordered time-domain aliased frame and dividing the resulting signal into relatively shorter overlapped segments.

11. The method of claim 1, comprising the step of performing windowing based on said overlapped frame to generate an overlapped windowed frame, and said step of performing time-domain aliasing is based on the overlapped windowed frame.

12. The method of claim 1, wherein said step of performing segmentation comprises the step of performing non-uniform segmentation.

13. The method of claim 12, wherein said step of performing non-uniform segmentation is performed by using windows of different lengths for the segmentation.

14. The method of claim 12, wherein said step of performing non-uniform segmentation comprises a first segmentation into at least two segments, and a second segmentation of at least one of said at least two segments into further segments.

15. The method of claim 1, wherein at least said steps of performing segmentation in time and performing spectral analysis are performed in response to detection of a transient in said input signal.

16. The method of claim 1, wherein said signal processing is used for coding, and the fidelity with respect to coding efficiency is analyzed for different segmentations, and a suitable segmentation is selected based on the analysis.

17. The method of claim 1, wherein said steps of performing time-domain aliasing, performing segmentation in time and performing spectral analysis are repeated for each of a number of consecutive overlapped frames.

18. A device for signal processing operating on overlapped frames of an input signal, said device comprising:

means for performing time-domain aliasing (TDA) based on an overlapped frame, having a length 2N, to generate a time-domain aliased frame having a length N;

means for performing segmentation in time based on the time-domain aliased frame of length N to generate at least two overlapped segments, said means for performing segmentation being configured for producing a frame having a length larger than N based on the time-domain aliased frame and then dividing the resulting produced frame into overlapped segments each having a length equal to or smaller than N; and a spectral analyzer configured for performing segmented spectral analysis based on said at least two overlapped segments by applying, on each of said at least two overlapped segments, a transform adapted for the segment to obtain, for each segment, a corresponding set of coefficients representative of the frequency content of the segment.

19. The device of claim 18, wherein said signal processing device is configured for at least one of signal analysis, signal compression and audio coding.

20. The device of claim 18, wherein said spectral analyzer for performing segmented spectral analysis is configured for transform coding and comprises means for applying a Modified Discrete Cosine Transform (MDCT) on each of said at least two segments, said MDCT being formed by a time domain aliasing operation (TDA) stage followed by a second stage based on a type IV Discrete Cosine Transform (DCT), and each segment has a length smaller than N.

21. The device of claim 18, wherein said spectral analyzer for performing segmented spectral analysis is configured for transform coding and comprises means for applying a transform on each of said at least two segments, wherein said means for applying a transform is configured to operate based on at least one of a Lapped Transform (LT), a Discrete Cosine Transform (DCT), a Modified Discrete Cosine Transform (MDCT), and a Modulated Lapped Transform (MLT).

22. The device of claim 18, comprising means for switching, in dependence on detection of a signal transient in said input signal, between non-segmented spectral analysis based on said time-domain aliased frame, and segmented spectral analysis based on said at least two segments.

23. The device of claim 18, comprising means for switching time resolution of said means for performing segmentation and said spectral analyzer.

24. The device of claim 18, wherein said means for performing segmentation is configured for generating at least one of the following types of segments: overlapped segments, non-uniform length segments, and uniform length segments.

25. The device of claim 18, wherein said means for performing segmentation is operable for generating a selectable number of overlapped segments, and said spectral analyzer for performing segmented spectral analysis comprises means for applying a lapped transform on each of said overlapped segment.

26. The device of claim 18, comprising means for reordering the time-domain aliased frame to generate a reordered time-domain aliased frame, and said means for performing segmentation is configured to operate based on the re-ordered time-domain aliased frame.

27. The device of claim 26, wherein said means for performing segmentation comprises means for adding zero padding to the re-ordered time-domain aliased frame and means for dividing the resulting signal frame into relatively shorter overlapped segments.

28. The device of claim 18, comprising means for performing windowing based on said overlapped frame to generate an overlapped windowed frame, and said means for performing time-domain aliasing is configured to operate based on the overlapped windowed frame.

29. The device of claim 18, wherein said means for performing segmentation comprises means for performing non-uniform segmentation.

30. The device of claim 29, wherein said means for performing non-uniform segmentation is operable for using windows of different lengths for the segmentation.

31. The device of claim 29, wherein said means for performing non-uniform segmentation comprises means for performing a first segmentation into at least two segments, and means for performing a second segmentation of at least one of said at least two segments into further segments.

32. The device of claim 18, wherein the device operations of segmentation and segmented spectral analysis are triggered in response to detection of a transient in said input signal.

33. An audio encoder operating on overlapped frames of an audio signal, said audio encoder comprising:

a time-domain aliasing (TDA) unit configured to generate a time-domain aliased frame having a length N based on an overlapped frame having a length 2N;

a time-segmentation unit configured to generate, based on the time-domain aliased frame of length N, a selectable number of overlapped segments, where said selectable number is equal to or greater than 2, said time-segmentation unit being configured for producing a frame having a length larger than N based on the time-domain aliased frame and then dividing the resulting produced frame into overlapped segments each having a length equal to or smaller than N; and a transform coder configured to perform segmented spectral analysis based on said overlapped segments by applying, on each of said overlapped segments, a transform adapted for the segment to obtain, for each segment, a corresponding set of spectral coefficients representative of the frequency content of the segment.

34. The audio encoder of claim 33, comprising means for switching, in dependence on detection of a signal transient in said audio signal, between non-segmented spectral analysis based on said time-domain aliased frame, and segmented spectral analysis based on said N signal segments.

35. The audio encoder of claim 33, wherein said transform coder is configured for applying a Modified Discrete Cosine Transform (MDCT) on each segment, said MDCT being formed by a time domain aliasing operation (TDA) stage followed by a second stage based on a type IV Discrete Cosine Transform (DCT), and each segment has a length smaller than N.

36. The audio encoder of claim 33, wherein said transform coder is configured for applying a transform on each segment, wherein said segments are overlapped segments, and said transform is a Modified Discrete Cosine Transform (MDCT) using a type IV Discrete Cosine Transform (DCT).

37. The audio encoder of claim 33, wherein said audio encoder comprises a windowing unit configured to perform windowing based on said overlapped frame to generate an overlapped windowed frame, and said TDA unit is configured to perform time-domain aliasing based on the overlapped windowed frame, and said device also comprises a re-ordering unit configured to re-order the time-domain aliased frame to generate a re-ordered time-domain aliased frame, and said time-segmentation unit is configured to operate based on the re-ordered time-domain aliased frame.

38. A method for signal processing operating based on spectral coefficients representative of a time-domain signal, said method comprising the steps of:

performing inverse spectral analysis based on different sub-sets of said spectral coefficients by applying an inverse transform on each sub-set of spectral coefficients to generate, for each sub-set of spectral coefficients, an inverse-transformed sub-frame;

performing inverse time-segmentation based on overlapped inverse-transformed sub- frames, each having a length equal to or smaller than L, by windowing and overlap-adding said inverse-transformed sub-frames to combine said inverse-transformed sub-frames into a time- domain aliased frame of length L; and performing inverse time-domain aliasing based on said time-domain aliased frame to generate a time-domain frame of length 2L.

39. The method for signal processing of claim 38, wherein said signal processing includes at least one of signal synthesis and audio decoding.

40. The method of claim 38, wherein said step of performing inverse time-domain aliasing based on said time-domain aliased frame is performed to reconstruct a first time-domain frame, and said method further comprises the step of synthesizing said time-domain signal based on overlap-adding said first time-domain frame with a subsequent second reconstructed time-domain frame.

41. The method of claim 38, wherein said step of performing inverse spectral analysis includes the step of applying an inverse Modified Discrete Cosine Transform.

42. An audio decoder operating based on spectral coefficients representative of a time-domain signal, said audio decoder comprising:

an inverse transformer operating based on different sub-sets of said spectral coefficients and configured for applying an inverse transform on each sub-set of spectral coefficients to generate, for each sub-set of spectral coefficients, an inverse-transformed sub-frame;

means for performing inverse time-segmentation based on overlapped inverse- transformed sub-frames, each having a length equal to or smaller than L, said means for performing inverse time-segmentation being configured for windowing and overlap-adding said inverse-transformed sub-frames to combine said inverse-transformed sub-frames into a time- domain aliased frame of length L; and means for performing inverse time-domain aliasing based on said time-domain aliased frame to generate a time-domain frame of length 2L.

43. The audio decoder of claim 42, wherein said means for performing inverse time-domain aliasing based on said time-domain aliased frame is configured to reconstruct a first time-domain frame, and said audio decoder further comprises means for synthesizing said time-domain signal based on overlap-adding said first time-domain frame with a subsequent second reconstructed time-domain frame.

44. The audio decoder of claim 43, wherein said inverse transformer is configured for applying, on each one of said sub-sets of spectral coefficients, an inverse transform to generate corresponding inverse-transformed sub-frames.

45. The audio decoder of claim 44, wherein said inverse transform is the inverse Modified Discrete Cosine Transform (MDCT).

* * * * *

UNITED STATES PATENT AND TRADEMARK OFFICE

CERTIFICATE OF CORRECTION

PATENT NO. : 8,392,202 B2
APPLICATION NO. : 12/675461
DATED : March 5, 2013
INVENTOR(S) : Taleb It is certified that error appears in the above-identified patent and that said Letters Patent is hereby corrected as shown below:

On the Title Page, in Item (56), under "OTHER PUBLICATIONS", in Column 2, Line 3, delete "Procesing," and insert -- Processing, --, therefor.

On the Title Page, in Item (57), under "ABSTRACT", in Column 2, Line 6, delete "?segmented?" and insert -- "segmented" --, therefor.

In the Drawings

In Fig. 5, Sheet 5 of 22, delete " 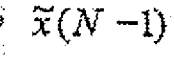 " and insert -- 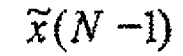 --, therefor.

In Fig. 5, Sheet 5 of 22, delete " 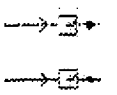 " and insert -- 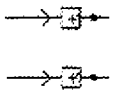 --, therefor.

In Fig. 12, Sheet 12 of 22, delete " 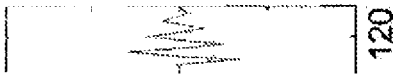 " and insert -- 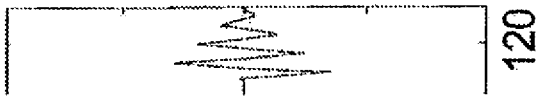 --, therefor.

Signed and Sealed this
Eighteenth Day of June, 2013

Teresa Stanek Rea
*Acting Director of the United States Patent and Trademark Office*

In Fig. 20, Sheet 20 of 22, delete "Norm adjustement" and insert -- Norm adjustment --, therefor.

In the Specifications

In Column 2, Line 28, delete "theses" and insert -- these --, therefor.

In Column 6, Line 38, delete "$Y_N$," and insert -- $Y_N$ --, therefor.

In Column 6, Line 67, delete "possible.-" and insert -- possible. --, therefor.

In Column 15, Line 29, delete " $\tilde{x}^{(r)}$ " and insert -- $\tilde{x}^{(r)}(n)$ --, therefor.

In Column 15, Lines 44-45, delete "uberlappender" and insert -- überlappender --, therefor.

In Column 15, Line 45, delete "and" and insert -- und --, therefor.

In Column 15, Line 52, delete "Cony." and insert -- Conv. --, therefor.

In the Claims

In Column 16, Line 23, in Claim 4, delete "(L T)," and insert -- (LT), --, therefor.